US011285529B2

(12) United States Patent
Field et al.

(10) Patent No.: US 11,285,529 B2
(45) Date of Patent: Mar. 29, 2022

(54) ALUMINUM-FREE STEEL ALLOYS AND METHODS FOR MAKING THE SAME

(71) Applicant: NUCOR CORPORATION, Charlotte, NC (US)

(72) Inventors: Daniel Morye Field, Abingdon, MD (US); David C. Van Aken, Rolla, MO (US)

(73) Assignee: Nucor Corporation, Charlotte, NC (US)

( * ) Notice: Subject to any disclaimer, the term of this patent is extended or adjusted under 35 U.S.C. 154(b) by 222 days.

(21) Appl. No.: 16/393,250

(22) Filed: Apr. 24, 2019

(65) Prior Publication Data

US 2019/0321879 A1 Oct. 24, 2019

Related U.S. Application Data

(60) Provisional application No. 62/662,206, filed on Apr. 24, 2018.

(51) Int. Cl.

| | |
|---|---|
| ***B22D 11/00*** | (2006.01) |
| ***C22C 38/38*** | (2006.01) |
| ***C22C 38/26*** | (2006.01) |
| ***C22C 38/02*** | (2006.01) |
| ***C22C 38/00*** | (2006.01) |
| ***B22D 11/06*** | (2006.01) |
| ***C21D 8/02*** | (2006.01) |

(Continued)

(52) U.S. Cl.

CPC ..... *B22D 11/001* (2013.01); *B22D 11/0622* (2013.01); *C21D 6/002* (2013.01); *C21D 6/005* (2013.01); *C21D 6/008* (2013.01); *C21D 8/0205* (2013.01); *C21D 8/0236* (2013.01); *C21D 9/52* (2013.01); *C22C 38/001* (2013.01); *C22C 38/02* (2013.01); *C22C 38/26* (2013.01); *C22C 38/38* (2013.01); *C21D 2211/001* (2013.01); *C21D 2211/008* (2013.01)

(58) Field of Classification Search

CPC ..... C21D 2211/001; C21D 2211/008

See application file for complete search history.

(56) References Cited

U.S. PATENT DOCUMENTS

2002/0043358 A1 4/2002 Strezov et al.
2011/0108228 A1 5/2011 Mahapatra et al.

(Continued)

FOREIGN PATENT DOCUMENTS

JP 05255813 A * 10/1993
JP 6213696 B1 10/2017

(Continued)

OTHER PUBLICATIONS

JPH05255813 English (Year: 2021).*

(Continued)

*Primary Examiner* — Robert S Jones, Jr.
*Assistant Examiner* — Jiangtian Xu
(74) *Attorney, Agent, or Firm* — Hahn Loeser & Parks LLP

(57) ABSTRACT

Disclosed herein are TRIP (transformation induced plasticity) steel alloy thin metal strips or, stated differently, high strength, high ductility steel alloy thin metal strips formed of a composition described herein, being substantially free or free of aluminum. In being substantially free, the aluminum content is equal to or less than 0.01% by weight.

33 Claims, 23 Drawing Sheets
(9 of 23 Drawing Sheet(s) Filed in Color)

(51) Int. Cl.
*C21D 6/00* (2006.01)
*C21D 9/52* (2006.01)

(56) References Cited

U.S. PATENT DOCUMENTS

| | | | | |
|---|---|---|---|---|
| 2011/0308673 | A1 | 12/2011 | Schneider et al. | |
| 2015/0176108 | A1 | 6/2015 | Edelman | |
| 2016/0177411 | A1 | 6/2016 | Watson et al. | |
| 2017/0130292 | A1* | 5/2017 | Mohanty | C22C 38/34 |
| 2020/0087764 | A1* | 3/2020 | Sano | C23C 2/06 |

FOREIGN PATENT DOCUMENTS

| | | | |
|---|---|---|---|
| WO | 2017211952 | A1 | 12/2017 |
| WO | 2018036918 | A1 | 3/2018 |

OTHER PUBLICATIONS

Australian Patent Office Interational-Type Search Report for AU2018901707 dated Jun. 15, 2018, 8 pages.

D. Field, D Van Aken, Tensile behavior of medium-Mn that exhibit two-stage TRIP behavior Int. Symp of Advanced High Strength Steels, May 2017, abstract, ISBN 978-1-935117-67-4, 1 page.

Limmer et al., Ab inito simulation of alloying effect on stacking fault energy in fcc Fe, Computational Materials Science, vol. 99, Mar. 2015, pp. 253-255.

S. Shin, M. Kwon, W. Cho, I. S. Suh, and B.C. De Cooman, The effect of grain size on the damping capacity of Fe-17 wt%Mn, Mater. Sci. & Eng. 2017, vol. 683, pp. 187-194.

S.K. Huang, Y.H. Wen, N. Li, J. Teng, S. Ding, Y.G. Xu, Application of damping mechanism model and stacking fault probability in Fe—Mn alloy, Materials Characterization, Jun. 2008, vol. 59, Issue 6, pp. 681-687.

G.B. Olson, M. Cohen, A general mechanism of martensitic nucleation: Part 1. General Concepts and the FCC -> HCP transformation, Met Trans A, vol. 7, Issue 12, Dec. 1976, pp. 1897-1904.

S.T. Pisarik and D.C. Van Aken, Thermodynamic Driving Force of the $\gamma \rightarrow \varepsilon$ Transformation and Resulting Ms Temperature in High Mn Steels, Met Mater. Trans A., vol. 47A Mar. 2016, pp. 1009-1018.

D.M. Field, D.S. Baker, and D.C. Van Aken, On the Prediction of $\alpha$-Martensite Temperatures in Medium Manganese Steels, Met Mater. Trans A, vol. 48A, May 2017, pp. 2150-2163.

D. M. Field, D.C. Van Aken, "Nanocrystalline Advanced High Strength Steel Produced by Cold Rolling and Annealing," Met Mater Trans A., May 2016, vol. 47A pp. 1912-1917.

PCT/US2019/028890 International Search Report and Written Opinion dated Jul. 24, 2019, 10 pages.

* cited by examiner

| Alloy | Composition (wt. pct.) | | | | | | Calculated Parameters* | | | |
|---|---|---|---|---|---|---|---|---|---|---|
| | Mn | Si | Cr | C | N | Nb | SFE mJ/m$^2$ | $Ms^{\varepsilon}$ (°C) | $Ms^{\alpha}$ (°C) | ΔMs (C°) |
| 1 | 14.5 | 1 | 1 | 0.20 | 0.003 | 0.05 | -2.1 | 111 | 203 | -92 |
| 2 | 13.75 | 1 | 3 | 0.15 | 0.003 | 0.05 | -1.3 | 106 | 203 | -97 |
| 3 | 13.0 | 1 | 5 | 0.10 | 0.003 | 0.05 | -0.4 | 101 | 200 | -99 |

| Alloy | Composition (wt. pct.) | | | | | | Calculated Parameters* | | | Vol % Phase | | |
|---|---|---|---|---|---|---|---|---|---|---|---|---|
| | Mn | Si | Al | Cr | C | N | $Ms^{\varepsilon}$ (°C) | $Ms^{\alpha}$ (°C) | ΔMs (C°) | γ | ε | α |
| 7.8 SFE | 15.1 | 1.95 | 1.40 | - | 0.08 | 0.017 | 42 | 154 | -112 | 79 | 0 | 21 |
| 0.7 SFE | 11.9 | 1.2 | - | 4.6 | 0.17 | 0.043 | 93 | 194 | -101 | 23 | 51 | 26 |

| Alloy | Solidification Range (C°) | Solvus Temperature (°C) | | | |
|---|---|---|---|---|---|
| | | α-ferrite | $M_{23}(CN)_6$ | $M_7C_3$ | NbC |
| 1 | 76 | 575 | 607 | 658 | 1240 |
| 2 | 68 | 570 | 750 | - | 1200 |
| 3 | 57 | 579 | 770 | - | 1150 |

| Alloy | Austenite Composition (wt. pct.) | | | | | Calculated parameters | | | | |
|---|---|---|---|---|---|---|---|---|---|---|
| | Mn | Si | Cr | C | N | SFE mJ/m$^2$ | ΔMs (C°) | $M_{23}(CN)_6$ (wt. %) | α-ferrite (wt. %) | γ-austenite (wt. %) |
| 1 | 17.8 | 1.02 | 0.45 | 0.06 | 0.001 | -3.3 | -121 | 2.8 | 29 | 46 |
| 2 | 17.6 | 1.01 | 1.85 | 0.07 | 0.001 | -1.4 | -165 | 2.5 | 31 | 50 |
| 3 | 17.0 | 0.96 | 4.34 | 0.001 | 0.001 | -0.6 | -172 | 1.7 | 32 | 60 |

| Alloy | C | Mn | Si | Cr | Al | Nb | N | SFE | $Ms^{\varepsilon}$ (°C) | $Ms^{\alpha}$ (°C) |
|---|---|---|---|---|---|---|---|---|---|---|
| Cr | 0.16 | 13.9 | 1.1 | 3.3 | 0.03 | 0.042 | 0.016 | -0.9 | 103 | 219 |
| Cr + Al | 0.17 | 14.0 | 1.2 | 3.2 | 1.6 | 0.051 | 0.033 | 10.6 | -4 | 232 |

| Dip | Chemistry | Super Heat, $^0$C | Covering gas |
|---|---|---|---|
| 1 | 0.17C-14.0Mn-1.2Si-**0Cr** | 100 | Ar |
| 2 | 0.17C-14.0Mn-1.2Si-**0Cr** | 100 | $N_2$ |
| 3 | 0.17C-14.0Mn-1.2Si-**3.2Cr** | 100 | $N_2$ |

FIG. 15

| Alloy | YS MPa (ksi) | UTS MPa (ksi) | % elongation | K (MPa) | n |
|---|---|---|---|---|---|
| Cr | 232 ± 4 (34 ± 0.5) | 1390 ± 52 (201 ± 8) | 42.6 ± 0.4 | 4310 ± 350 (625 ± 51) | 0.69 ± 0.04 |
| Cr + Al | 523 ± 18 (75.8 ± 2.6) | 1140 ± 35 (165 ± 5) | 53.6 ± 1.2 | 2890 ± 126 (420 ± 18) | 0.57 ± 0.02 |

| Alloy | Annealing Temp °C (°F) | YS MPa (ksi) | UTS MPa (ksi) | % elongation | K (MPa) | n |
|---|---|---|---|---|---|---|
| Cr | 600 (1112) | 700 (101) | 1381 (200) | 29.0 | 3370 (489) | 0.44 |
| | 628 (1162) | 680 (98) | 1366 (186) | 30.7 | 3350 (486) | 0.45 |
| | 650 (1202) | 660 (96) | 1399 (202) | 32.0 | 3620 (525) | 0.52 |
| Cr + Al | 600 (1112) | 880 (130) | 1090 (160) | 34.0 | 1880 (270) | 0.23 |
| | 628 (1162) | 580 (84) | 1140 (166) | 42.9 | 2890 (420) | 0.55 |
| | 650 (1202) | 540 (78) | 1150 (167) | 58.8 | 2950 (428) | 0.59 |

FIG. 19

| Alloy | Composition (wt. pct.) | | | | | | | Calculated Parameters* | | |
|---|---|---|---|---|---|---|---|---|---|---|
| | Mn | Si | Al | Cr | C | N | Nb | $Ms^{\varepsilon}$ (°C) | $Ms^{\alpha}$ (°C) | ΔMs (C°) |
| 13.3SFE | 13.9 | 2.07 | 2.01 | - | 0.09 | 0.012 | - | -3 | 117 | -120 |
| 7.8SFE | 15.1 | 1.95 | 1.4 | - | 0.08 | 0.017 | - | 42 | 154 | -112 |
| 5.0SFE | 14.3 | 2.97 | 0.89 | - | 0.16 | 0.022 | - | 63 | 158 | -95 |
| -0.2SFE | 10.2 | 2.38 | 0.3 | - | 0.17 | 0.024 | - | 93 | 150 | -57 |
| -1.8SFE | 11.5 | 2.46 | 0.38 | - | 0.11 | 0.029 | - | 105 | 163 | -58 |
| -2.1SFE | 13.8 | 2.01 | 0.4 | - | 0.1 | 0.028 | - | 110 | 86 | 24 |
| -2.2SFE | 13 | 1.57 | 0.45 | - | 0.1 | 0.045 | - | 109 | 46 | 63 |
| 0.7SFE | 11.9 | 1.2 | - | 4.6 | 0.17 | 0.043 | 0.045 | 92 | 202 | -110 |

FIG. 23

| Alloy | Composition (wt. pct.) | | | | | FactSage | Calc. Parameters | | Measured Phases (vol. %) | | |
|---|---|---|---|---|---|---|---|---|---|---|---|
| | Mn | Si | Al | Cr | C | Temp. (°C) | $Ms^{\varepsilon}$ (°C) | SFE $mJ/m^2$ | γ | ε | α |
| 13.3SFE | 18.5 | 2.10 | 1.76 | - | 0.13 | 515 | -30 | 15.9 | 69 | 0 | 31 |
| 7.8SFE | 21.0 | 1.96 | 1.16 | - | 0.12 | 540 | -15 | 14.2 | 60 | 0 | 40 |
| 5.0SFE | 16.4 | 2.92 | 0.79 | - | 0.19 | 530 | 56 | 6.1 | 64 | 30 | 6 |
| -0.2SFE | 18.6 | 2.14 | 0.19 | - | 0.40 | 535 | 50 | 6.9 | 32 | 10 | 58 |
| -1.8SFE | 18.5 | 2.31 | 0.23 | - | 0.22 | 520 | 77 | 3.5 | 34 | 13 | 53 |
| -2.1SFE | 17.3 | 2.00 | 0.27 | - | 0.14 | 520 | 98 | 0.4 | 67 | 14 | 19 |
| -2.2SFE | 14.8 | 1.60 | 0.31 | - | 0.12 | 515 | 113 | -2.3 | 64 | 33 | 3 |
| 0.7SFE | 15.9 | 1.23 | - | 2.98 | 0.05 | 525 | 119 | -2.6 | 37 | 33 | 30 |

FIG. 24

ALUMINUM-FREE STEEL ALLOYS AND METHODS FOR MAKING THE SAME

CROSS-REFERENCE TO RELATED APPLICATIONS

This application claims priority to, and the benefit of, U.S. Provisional Application No. 62/662,206 filed on Apr. 24, 2018 with the United States Patent Office, which is hereby incorporated by reference.

BACKGROUND

This invention relates to TRIP steel alloy thin cast products, such as strips and sheets, and methods for making the same, such as by a twin roll caster.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

In the past, high-strength low-carbon thin strip with yield strengths of 413 MPa (60 ksi) or higher, in strip thicknesses less than 3.0 millimeters (mm), have been made by recovery annealing of cold rolled strip. Cold rolling was required to produce the desired thickness. The cold roll strip was then recovery annealed to improve the ductility without significantly reducing the strength. However, the final ductility of the resulting strip was still relatively low and the strip would not achieve total elongation levels over 6%, which is required by some building codes for steels used for structural components. Such recovery annealed, cold rolled, low-carbon steel was generally suitable only for simple forming operations, e.g., roll forming and bending. Producing steel strip with higher ductility using the cold rolled and recovery annealed manufacturing route was not technically feasible in these final strip thicknesses.

Throughout the years, the demand for high strength steels has increased. But generally, there has been a compromise between strength and ductility. However, Transformation Induced Plasticity (TRIP) steel is a type of steel alloy, which exhibits both excellent strength and ductility. TRIP steel has a triple phase microstructure consisting of ferrite, bainite, and retained austenite. Transformation induced plasticity refers to the transformation of retained austenite to martensite during plastic deformation. See M. Zhang, *Continuous cooling transformation diagrams and properties of micro-alloyed TRIP steels*, Materials Science and Engineering A 438-440, 2006. This property allows TRIP steels to have a high formability (i.e. achieve greater elongation), while retaining excellent strength. Generally, the transformation of retained austenite produces a high carbon martensite phase that is very brittle; however, in TRIP steel, the retained austenite is finely dispersed in the ferrite phase. This fine dispersion allows TRIP steels to retain their tensile strength while increasing the total elongation. See also, William D. Callister, *Materials Science and Engineering An Introduction,* 7th edition, Wiley, 2007, pg. 292.

One advantage of TRIP steels is that they have higher ductility than other steels with similar tensile strength. TRIP steels are suitable for structural and reinforcement parts of complex shapes. For example, the ductility and strength of TRIP steels make them a good candidate for automotive applications. Structural components can be made thinner because TRIP steels have the ductility necessary to withstand high deformation processes such as stamping, as well as the strength and energy absorption characteristics to meet safety regulations for automotive parts. TRIP steels also have high strain hardening capacity. They exhibit good strain redistribution and thus, good drawability. High strain hardening capacity and high mechanical strength lend these steels good energy absorption capacity. TRIP steels also exhibit a strong bake hardening (BH) effect following deformation, which further improves their crash performance.

TRIP steels often contain significant additions of aluminum, sometimes up to several weight percent. High levels of aluminum present challenges to all continuous casting operations due to the possibility of alumina formation and associated clogging. In strip casting, the orifices through which the steel must flow measure tens of millimeters. It follows that the formation of alumina can create a situation where these orifices become clogged with alumina, which is certainly problematic for the casting process.

Therefore, there is still a need for a high strength high ductility alloy sheet that is better composed for manufacture.

SUMMARY

Disclosed herein are TRIP (transformation induced plasticity) steel alloy thin metal strips or, stated differently, high strength, high ductility steel alloy thin metal strips formed of a composition described herein, being substantially free or free of aluminum. In being substantially free, the aluminum content is equal to or less than 0.01% by weight. As used herein, "sheet" includes plate or strip unless specifically stated otherwise.

In particular instances, such methods of forming a TRIP steel thin metal strip included:

- providing and/or assembling a pair of counter-rotatable casting rolls having casting surfaces laterally positioned to form a gap at a nip between the casting rolls through which a thin metal strip having an as-cast thickness of less than 3 mm can be cast;
- providing and/or assembling a metal delivery system adapted to deliver molten metal above the nip to form a casting pool, the casting pool being supported on the casting surfaces of the pair of counter-rotatable casting rolls and confined at the ends of the casting rolls;
- delivering a molten steel to the metal delivery system;
- delivering the molten metal from metal delivery system above the nip to form the casting pool; and
- counter rotating the pair of counter-rotatable casting rolls to form metal shells on the casting surfaces of the casting rolls that are brought together at the nip to deliver the thin metal strip downwardly, the thin metal strip (or more broadly, sheet) having an as-cast thickness less than 3 mm or less than 2 mm, the thin metal strip being formed of a steel alloy composition comprising:
- by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting.

In one specific embodiment of a method of forming a TRIP steel thin metal strip as produced by the steps of above, the thin metal strip being formed of a steel alloy composition may comprise:

by weight, up to substantially 0.23% carbon, substantially between 1.0% and 6% chromium, greater than 12% and up to 17.5% manganese, substantially between 0.5% and 1.75% silicon, and iron, with a residual aluminum content of less than 0.01% aluminum and other impurities resulting from melting.

More generally, a TRIP steel thin metal strip can be described as having an as-cast thickness of less than 3 mm or 2 mm, where the thin metal strip is formed of a steel alloy composition comprising by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting.

In one specific embodiment of a TRIP steel thin metal strip, the TRIP steel thin metal strip can be described as having an as-cast thickness of less than 3 mm or 2 mm, where the thin metal strip is formed of a steel alloy composition comprising by weight, up to substantially 0.23% carbon, substantially between 1.0% and 6% chromium, greater than 12% and up to 17.5% manganese, substantially between 0.5% and 1.75% silicon, and iron, with a residual aluminum content of less than 0.01% aluminum and other impurities resulting from melting.

With regard to the specific compositions described above, in each case, the nitrogen content may be up to 0.02%, by weight. It is noted that the inclusion of up to 0.1% niobium by weight may be employed as a grain refiner and precipitation strengthener. While certain embodiments of the compositions provide that the thin metal strip comprises a composition characterized as having an ε-martensite start temperature ($Ms^{\varepsilon}$) measuring between 90° C. and 111° C., this temperature range may be broader in other variations since these temperatures are based upon calculations dependent upon variations that may arise due to various real-world factors. Likewise, in embodiments where the thin metal strip comprises a composition characterized as having an α-martensite start temperature ($Ms^{\alpha}$) measuring between 190° C., ±100° C., and 225° C., ±100° C., this temperature range may also be broader in other variations for the same reasons.

Further disclosed are methods of forming the TRIP (transformation induced plasticity) steel alloy sheets or, stated differently, high strength, high ductility steel alloy sheets. In particular instances, such sheets are cast, such as by use of a twin-roll caster, for example.

Additional details and other variations are described below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 15 is a table showing the parameters for three dips;

FIG. 19 is a table showing mechanical properties of the cold rolled and annealed alloys at various temperatures for 20 hours;

FIG. 23 is a table showing the bulk chemistries of the previously produced two-stage TRIP steels are shown with calculated SFE, calculated $Ms^{\alpha}$, $Ms^{\varepsilon}$, and ΔMs temperatures for single phase austenite;

FIG. 24 is a table showing austenite chemistry as predicted by FactSage 7.0™ for the eight alloys shown in FIG. 23 after adjusting the temperature of calculation to obtain an equivalent α-ferrite content;

DETAILED DESCRIPTION

Figure 3:
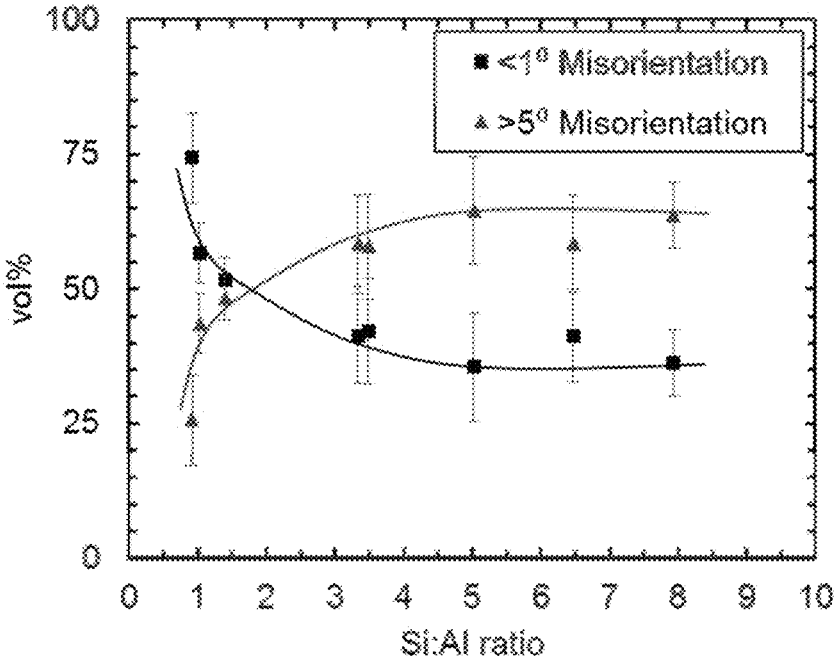
FIG. 3 is a graph showing a volume fraction of recrystallized and deformed grains determine from the electron backscattered diffraction images of the previously produced two-Stage TRIP steels.

It is known that alloying with Si, Al, and Cr promote the formation of hexagonal ε-martensite. Aluminum addition is beneficial with respect to recrystallization during hot rolling; however, these aluminum-containing alloys are more difficult to continuously cast. Furthermore, alloys with high Si show significant resistance to recrystallization during hot-working as shown in FIG. 3. Chromium has been previously proposed as being a suitable replacement for aluminum (Al) since the unstable stacking fault energy is reduced in a similar fashion to the addition of either silicon (Si) or Al. In addition, Cr has the benefit of reducing static strain aging, yield point elongation, and dynamic strain aging.

Optionally, it may be desired that the proposed alloy be flexible enough to produce plate, such as for military armor or automotive sheet. High strain rate testing on two-stage TRIP alloys has shown a positive strain rate dependence where both the flow stress and the true fracture strain increase with increasing strain rates. These attributes may be important, such as for both military armor and crashworthiness of automotive sheet.

It is then desirous for an alloy to be formulated for production as single phase γ-austenite in the hot rolled plate or sheet by cold-work and intercritical annealing where a tri-phase microstructure is produced, $M_{23}(C,N)_6$, to reduce dynamic strain aging associated with nitrogen interacting with dislocations in the ferrite formed during intercritical annealing and an γ-austenite composition that would produce the two-stage TRIP behavior. The single phase γ-austenite hot rolled plate or sheet may or may not have a fine grained microstructure. For example, when the single phase γ-austenite is formed using a strip casting system, such as a twin-roll casting system described below, the microstructure is not fine grained but may be subsequently treated, such as using thermo-cycling, to achieve fine grained microstructure.

Figure 4:
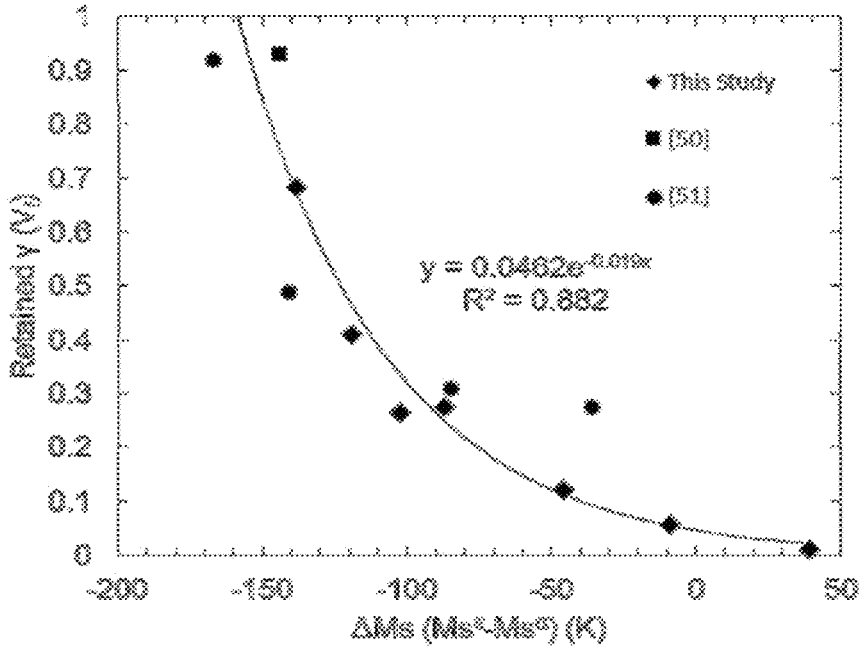
FIG. 4 is a graph showing a volume fraction of retained austenite at room temperature showing that formation of α-martensite prior to ε-martensite is beneficial in retaining austenite.

It is also desirous for the chemistry of the γ-austenite, whether as a single phase or tri-phase microstructure, to be formulated to maximize the amount of room temperature γ-austenite or ε-martensite. It has been observed for manganese alloys containing more than 13 wt. % Mn that the difference in martensite start temperatures between $Ms^{\varepsilon}$ and $Ms^{\alpha}$ should be negative to obtain higher volume fractions of austenite as shown in FIG. 4.

Figures 5, 6, 7:
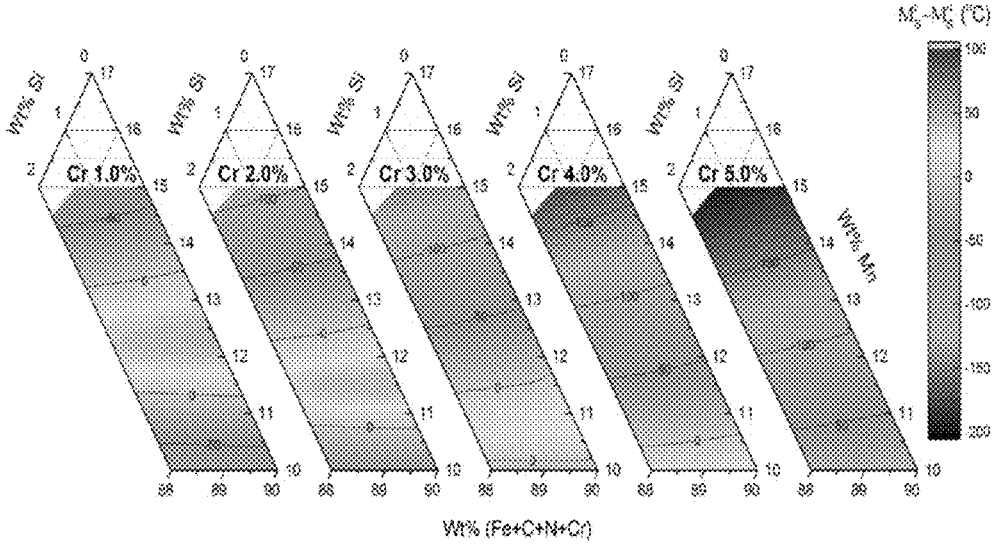
FIG. 5 is a table showing the composition, calculated stacking fault energy, and calculated start temperatures for ε and α martensites, of the three proposed two-Stage TRIP alloys.
FIG. 6 is a series of graphs showing the effect of Cr, Mn, and Si on the ΔMs of potential two-Stage TRIP alloys.
FIG. 7 is a table showing the composition, calculated stacking fault energy, and calculated start temperatures for ε and α martensites, where volume fractions of phases are determined from XRD of hot band alloys and where α denotes α-martensite.

An iterative process was used to formulate three potential alloys for investigation. FIG. 5 shows the chemistry of the potential alloys with the calculated values of stacking-fault energy (SFE), ε-martensite start temperature ($Ms^{\varepsilon}$), α-martensite start temperature ($Ms^{\alpha}$), and the difference in martensite start temperatures as $\Delta Ms = Ms^{\varepsilon} - Ms^{\alpha}$. The effect of Cr, Mn, and Si on the ΔMs with C and N fixed at 0.15 and 0.003 wt. %, respectively, is shown in FIG. 6.

Room temperature stacking fault energies were calculated using eq. (1) with n=2.

$$\mathrm{SFE}(\mathrm{mJ/m^2}) = n\rho(\Delta G^{\gamma\to\varepsilon}) + 2\sigma^{\gamma/\varepsilon} \quad \text{eq. (1)}$$

The start temperature for the ε-martensite ($Ms^{\varepsilon}$) was calculated by determining the temperature at which SFE=0 $mJ/m^2$ for the case of n=4. The α-martensite start temperature ($Ms^{\alpha}$) was calculated according to the work of D. M. Field, D. S. Baker, and D. C. Van Aken in *Met Trans A,* 2017, DOI. 10.1007/s 11661-017-4020-2, where the strain energy of transformation, ($\Delta G_{str}^{\gamma\to\alpha}$) was balanced against the chemical driving force ($\Delta G_{Chem}^{\gamma\to\alpha}$) according to eq. (2) and eq. (3).

$$\Delta G_{str} + \Delta G_{chem}^{\gamma\to\alpha} = 0 \quad \text{eq. (2)}$$

$$\Delta G_{str}(\mathrm{J/mol}) = E\Omega\delta^2(14.8 - 0.13T) \quad \text{eq. (3)}$$

where $\Delta G_{Chem}^{\gamma\to\alpha}$ is calculated according to a modified regular solution model described by D. M. Field, D. S. Baker, and D. C. Van Aken in *Met Trans A,* 2017, DOI. 10.1007/s 11661-017-4020-2. Omega (Ω) is the molar volume for iron, and delta (δ) is the lattice misfit between the γ-austenite and α-martensite. Single-phase ΔMs values were held constant at −96±4° C. based on results from the initial two-stage TRIP trials. The composition, Ms temperatures, and microstructural components of Al-containing, two-stage TRIP steel and the Cr-containing alloy of interest are shown in FIG. 7, and these alloys shall be designated according to their room temperature SFE for a single phase γ-austenite microstructure.

Figure 8A:
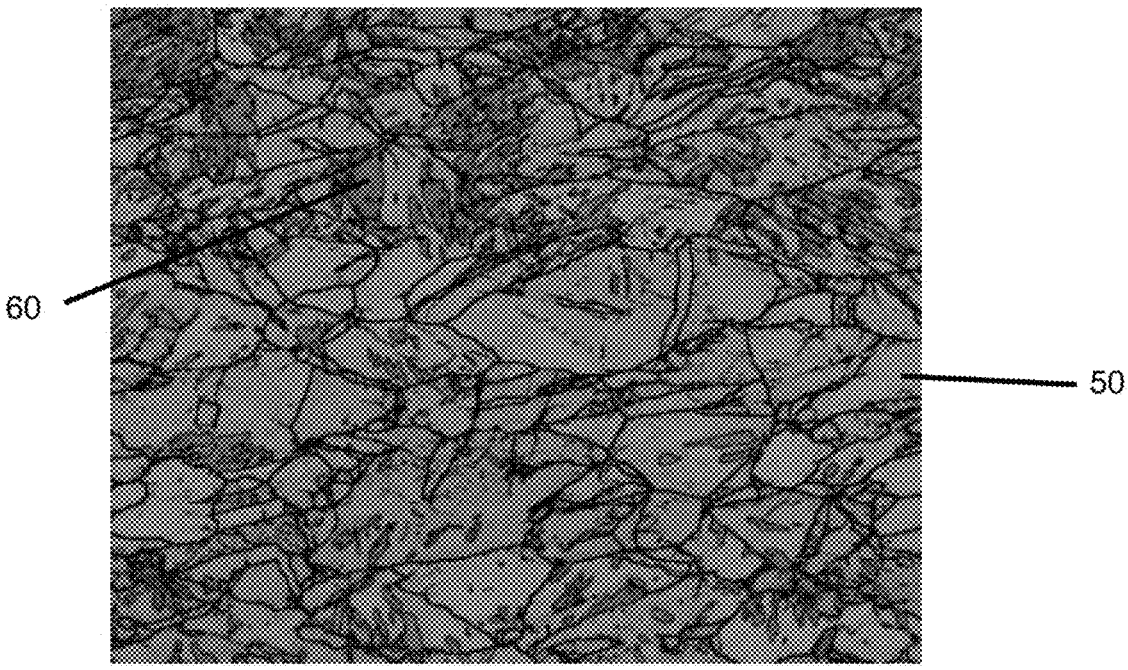
FIG. 8A is an image taken under magnification showing hot band EBSD microstructure of the 7.8 SFE alloy, showing γ-austenite 50 as green (more lightly shaded when shown in black & white/grayscale) and α-martensite 60 as blue (more darkly shaded when shown in black & white/grayscale), the smaller α-martensite being more prevalently shown in the upper portion of the image, the image including a micron marker (a black bar) indicating a reference distance of 50 microns within the image.
Figure 8B:
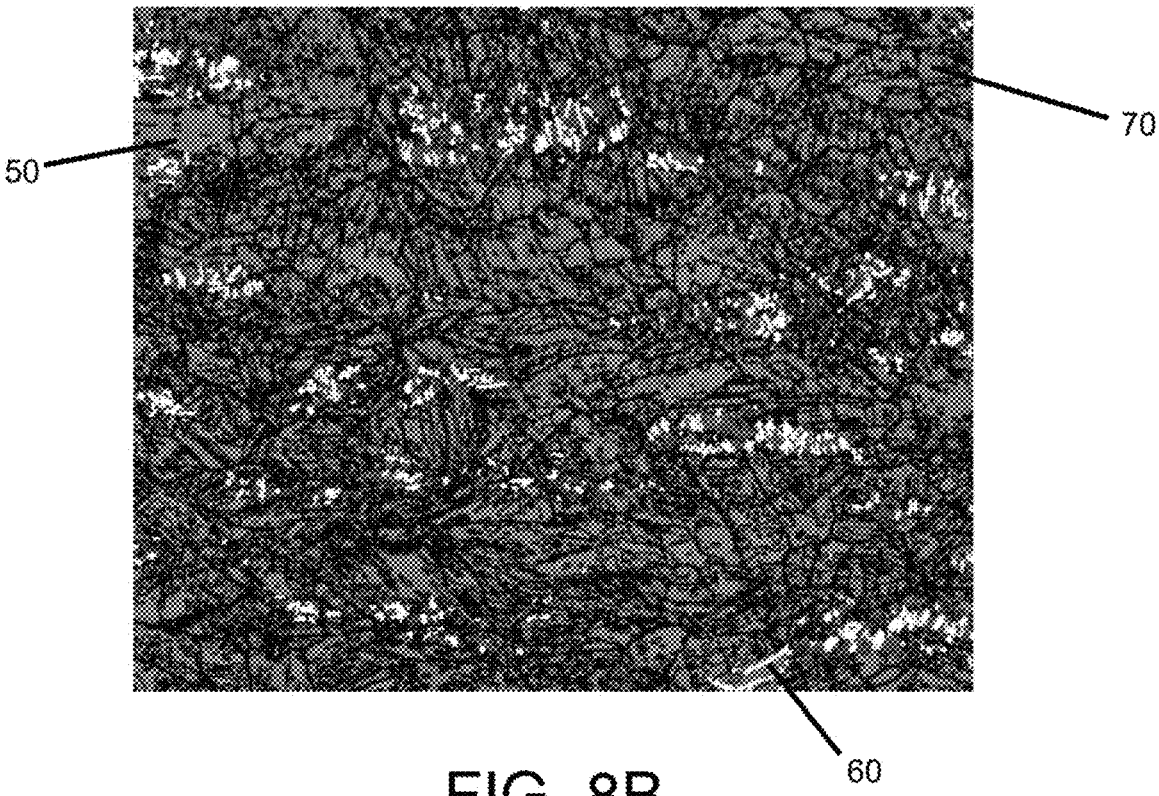
FIG. 8B is an image taken under magnification showing hot band EBSD microstructure of the 0.7 SFE alloy, showing γ-austenite 50 as green (more lightly shaded when shown in black & white/grayscale), ε-martensite 70 as red (moderately shaded when shown in black & white/grayscale), and α-martensite 60 as blue (more darkly shaded when shown in black & white/grayscale), where a balanced presence of γ-austenite and ε-martensite is shown with very minor presence of α-martensite, which on average is notably smaller in size relative to γ-austenite and ε-martensite, the image including a micron marker (a black bar) indicating a reference distance of 50 microns within the image.
Figures 8C, 9:
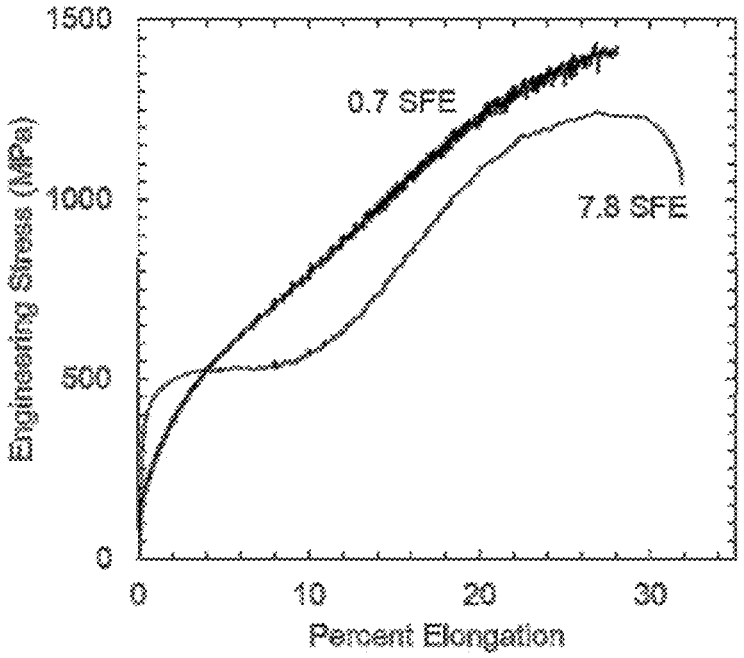
FIG. 8C is a chart showing the results of tensile testing performed on the hot band 7.8 and 0.7 SFE alloys.
FIG. 9 is a table showing the solidification range and solvus temperatures for the α-ferrite and carbides.

When comparing the 7.8 SFE and 0.7 SFE alloys of FIG. 7, the ΔMs are within 11° C. and the sum of γ-austenite and ε-martensite is very similar. It can also be seen that the 7.8 SFE alloy has a more negative ΔMs value (−112° C.) and contains a larger volume percent of γ-austenite in the hot band structure compared to the 0.7 SFE alloy. It is known that having a higher $Ms^{\alpha}$ temperature than $Ms^{\varepsilon}$ is beneficial in retaining γ-austenite. This phenomenon has been explained by comparing the minimum required defect size for the critical nuclei for α-martensite (n=14) and ε-martensite (n=4). Initial formation of α-martensite (n≥14) will use up the easy nucleating sites for ε-martensite (n≥4) reducing the amount of transformed γ-austenite. Segmenting of the austenite by α-martensite has the added benefit of constricting the growth of subsequent ε-martensite laths and thus reducing the volume transformation from a single ε-martensite nucleus. Total ε-martensite formed can also be related to the $Ms^{\varepsilon}$ as shown in FIG. 8B and comparison with the X-ray diffraction (XRD) results reported in FIG. 7. The higher $Ms^{\varepsilon}$ temperature of 93° C. in the 0.7 SFE alloy produces 24% ε-martensite compared to 0% ε-martensite produced in the 7.8 SFE steel with an $Ms^{\varepsilon}$ temperature of 42° C. FIG. 8A shows the hot band EBSD microstructure of the 7.8 SFE alloy, while FIG. 8B shows the hot band EBSD microstructure of the 0.7 SFE alloy. In each figure, γ-austenite 50 is shown as green (more lightly shaded when shown in black & white/grayscale), ε-martensite 70 is shown as red (moderately shaded when shown in black & white/grayscale), and α-martensite 60 is shown as blue (more darkly shaded when shown in black & white/grayscale). FIG. 8C is a chart showing the results of tensile testing performed on the hot band 7.8 and 0.7 SFE alloys.

Addition of niobium (Nb) and chromium (Cr) are expected to decrease the stability of the austenite through the formation of NbC and $M_{23}(C,N)_6$ precipitates. FactSage 7.0™ with the FSstel database was utilized to understand the solidification path, solvus temperatures of NbC and $M_{23}(C,N)_6$, and the composition of the intercritical γ-austenite for the alloys proposed in FIG. 5. The solidification range (calculated according to a Schiel segregation model using the 15% liquid as the solidus), $A_3$ temperature, and solvus temperatures for the $M_{23}(C,N)_6$ and NbC are shown in FIG. 9.

Figure 10A:
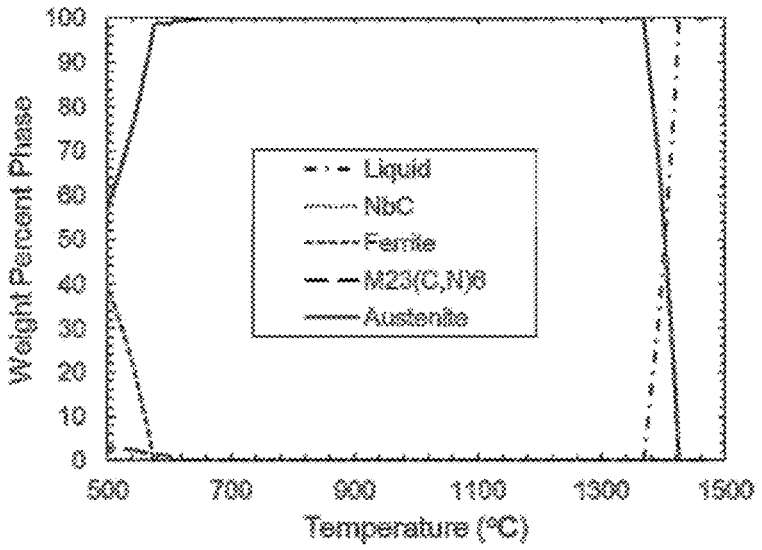
FIG. 10A is a chart showing the phases as a function of temperature for composition 1.
Figure 10B:
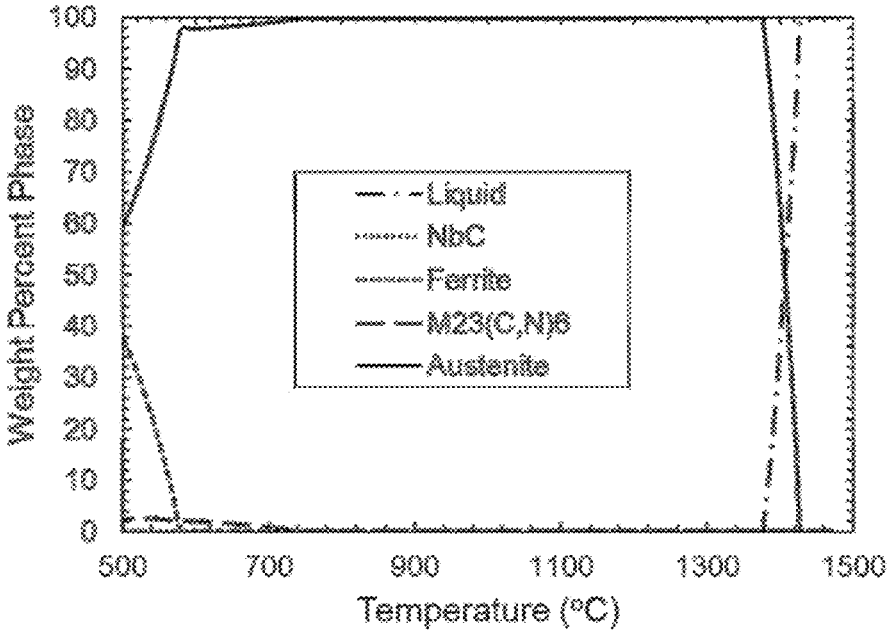
FIG. 10B is a chart showing the phases as a function of temperature for composition 2.
Figures 10C, 11:
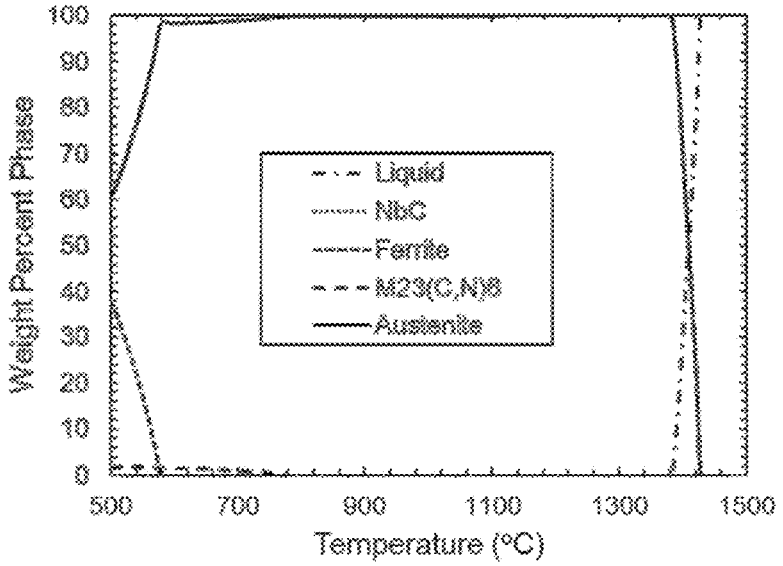
FIG. 10C is a chart showing the phases as a function of temperature for composition 3.
FIG. 11 is a table showing the calculated composition, and calculated ΔMs, of the three proposed two-Stage TRIP alloys, intercritical α-ferrite, and $M_{23}(C,N)_6$ is determined from FactSage 7.0™ calculation, at an intercritical annealing temperature of 525° C., with room temperature γ-austenite content being based on ΔMs calculation.

All three alloys in FIG. 9 have solidification ranges greater than 50° C., which are expected to encourage long metallurgical lengths during continuous casting. Furthermore, FactSage 7.0™ does not predict any α-ferrite at the intercritical annealing temperature of 600° C. for the proposed alloys. The solvus temperature for the $M_{23}(C,N)_6$ is significantly lower in Alloy 1 than the other two alloys; however, this resulted from the formation of an $M_7C_3$ carbide associated with the higher carbon content. $M_7C_3$ was not predicted in the other two alloys. Thus, Alloy 1 is excluded from further consideration as it may not have the desired effect of reducing nitrogen by precipitation of $M_{23}(C,N)_6$ during batch annealing. The phase fraction as a function of temperature for each of Alloys 1-3 is shown in FIGS. 10A-10C, respectively, the weight fraction of NbC being constant for all three compositions at 0.057 wt. %.

In an effort to predict the transformation characteristics of the austenite formed during batch annealing, a study comparing known microstructures in batch annealed materials were compared to the weight fractions of α-ferrite predicted using FactSage 7.0™ software. In addition, the predicted chemistry of the austenite was compared to the athermal martensite formed as observed after cooling to room temperature. A study of eight (8) alloys suggests a calculation temperature of 525±10° C. (depending upon the alloy system) best fits the experimental results obtained by annealing at 600° C. This temperature discrepancy between predicted and observed microstructures is attributed to the non-dilute solution condition for these heavily alloyed Mn-steels and contributions of a magnetic component to thermodynamic equilibrium.

Figure 25A:
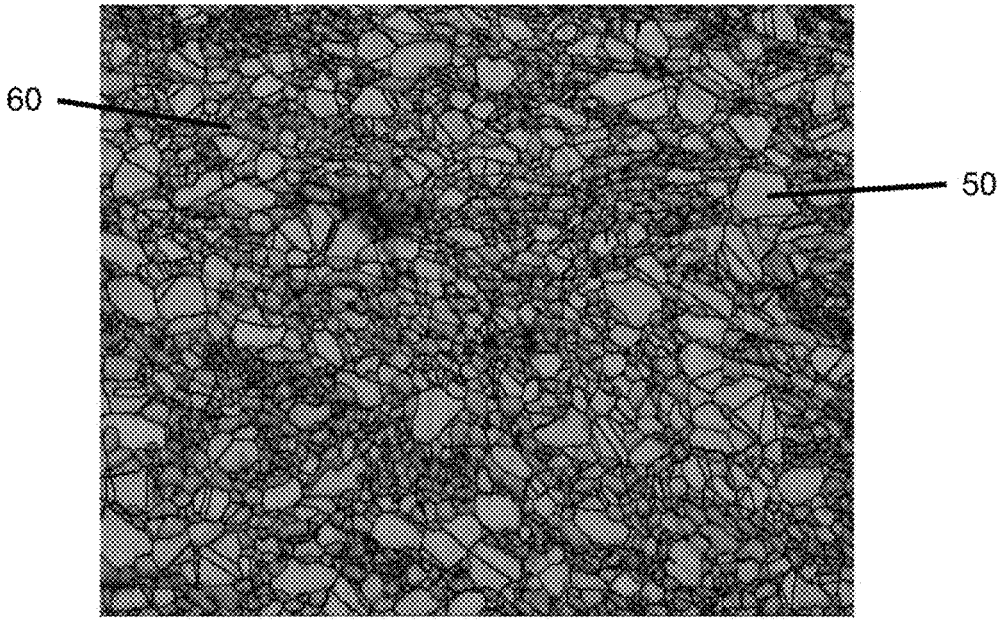
FIG. 25A is an image taken under magnification showing batch annealed EBSD-OIM of the 13.3 SFE alloy microstructure, showing α-ferrite 60 as blue (more darkly shaded when shown in black & white/grayscale) and γ-austenite 50 as green (more lightly shaded when shown in black & white/grayscale), where α-ferrite as shown is on average smaller than γ-austenite, the image including at the bottom a micron marker (a black bar) indicating a reference distance of 10 microns within the image.
Figure 25B:
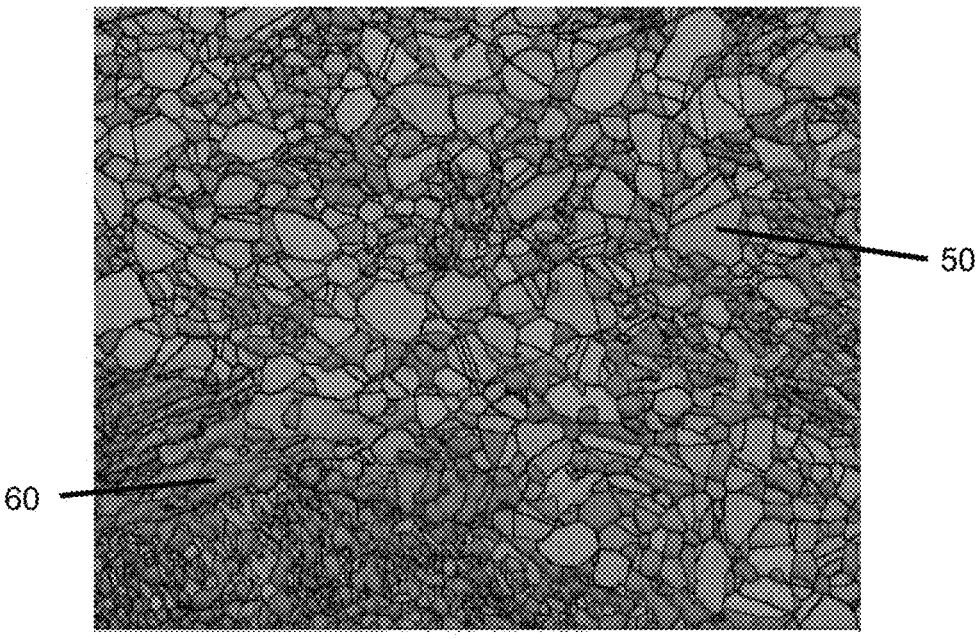
FIG. 25B is an image taken under magnification showing batch annealed EBSD-OIM of the 7.8SFE alloy microstructure, showing α-ferrite 60 as blue (more darkly shaded when shown in black & white/grayscale) and γ-austenite 50 as green (more lightly shaded when shown in black & white/grayscale), where α-ferrite as shown is on average smaller than γ-austenite, the image including at the bottom a micron marker (a black bar) indicating a reference distance of 10 microns within the image.
Figure 26A:
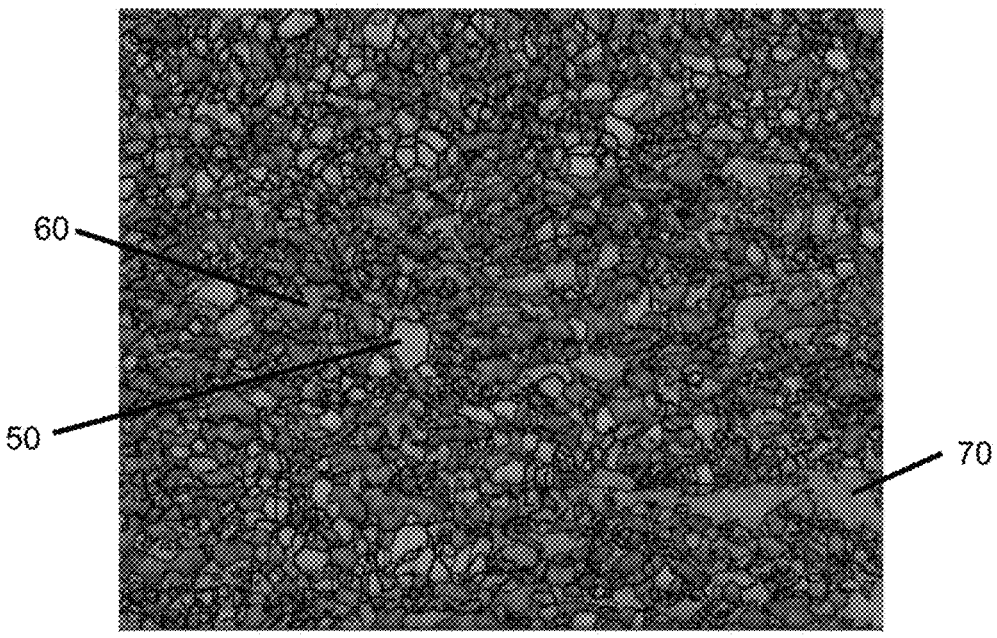
FIG. 26A is a batch annealed EBSD-OIM of the 0.7SFE alloy, showing α-ferrite 60 as blue (more darkly shaded when shown in black & white/grayscale), γ-austenite 50 as green (more lightly shaded when shown in black & white/grayscale), and ε-martensite 70 as red (more moderately shaded when shown in black & white/grayscale), where ε-martensite as shown is on average larger than α-ferrite and γ-austenite and is less prevalent, the bottom of the image including a micron marker (a black bar) indicating a reference distance of 5 microns within the image; and, FIG. 26B is an image taken under magnification showing batch annealed EBSD-OIM of the −1.8SFE alloy microstructure, showing α-ferrite 60 as blue (more darkly shaded when shown in black & white/grayscale), γ-austenite 50 as green (more lightly shaded when shown in black & white/grayscale), and ε-martensite 70 as red (more moderately shaded when shown in black & white/grayscale), the bottom of the image including a micron marker (a black bar) indicating a reference distance of 10 microns within the image.
Figure 26B:
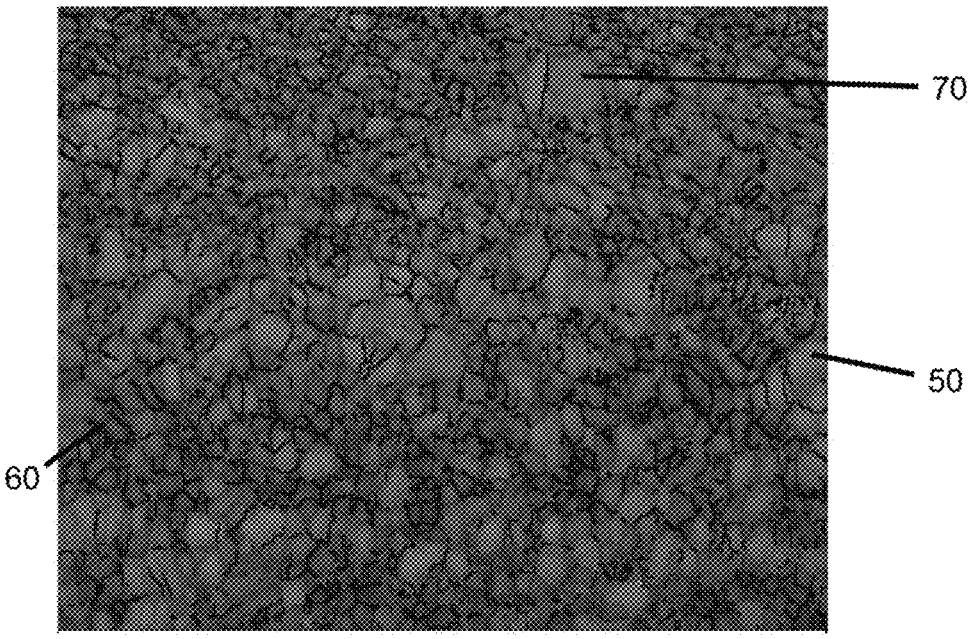

With regard to the study of eight (8) alloys noted previously, calculations were made to calibrate FactSage predictions for intercritical annealing with the observed batch annealed microstructures for the eight (8) alloys identified in FIG. 24. The objective was to determine the best temperature at which these thermodynamic calculations replicate the observed weight fraction of α-ferrite and austenite composition to produce the structures observed. It should be noted that the measured volume percent of α-phase in FIG. 25 is a combination of α-ferrite and α-martensite with the majority being α-ferrite in the batch annealed microstructure. This assumption is based on the morphology of the α-phase which is typically equiaxed, as shown in FIGS. 26A-26B and in FIGS. 27A-27B. Furthermore, it is assumed that the total austenite includes the portion of ε-martensite at the batch annealing temperature. The FactSage temperatures that best matched the 600° C. batch annealed microstructures averaged to be 525° C.±9.6° C. (68% confidence level, that is, where for every 100 tests conducted, 68 test results fall within the specified range).

Validation of the calculations shown in FIG. 25 is provided in FIGS. 26A-26B and in FIGS. 27A-27B. It should be noted that the thermodynamic model for predicting $Ms^{\alpha}$ (as provided by D. M. Field, D. S. Baker, and D. C. Van Aken in *Met Trans A,* 2017, DOI. 10.1007/s 11661-017-4020-2) may not work for Mn greater than 15 wt. %, where α-martensite has not been observed. After intercritical annealing, γ-austenite is enriched in manganese and calculated to contain up to 21 wt. % Mn. It is interesting to note that the 13.3SFE and 7.8SFE alloys have calculated $Ms^{\varepsilon}$ temperatures below 0° C. and contain no ε-martensite in room temperature microstructures as shown in FIG. 25 from XRD analysis as well as shown in the EBSD phase maps in FIGS. 26A-26B. Alloys that have calculated $Ms^{\varepsilon}$ temperatures above ambient contain athermal ε-martensite in room temperature microstructures as shown in FIGS. 27A-27B for the alloys −1.8SFE and 0.7SFE.

Predicted batch annealed microstructures for the proposed Alloys 1-3 are presented in FIG. 11, showing the austenite composition, calculated SFE, martensite start temperature difference (ΔMs), and phase composition by mass for the austenite. All three alloys (Alloys 1-3) show significant manganese enrichment of the austenite and the SFE is negative for all three indicating that the $Ms^{\varepsilon}$ is above ambient temperature. The negative difference in calculated Ms temperatures would suggest that the $Ms^{\alpha}$ is higher than the $Ms^{\varepsilon}$; however, the model for the athermal $Ms^{\alpha}$ temperature (as presented by D. M. Field, D. S. Baker, and D. C. Van Aken in *Met Trans A,* 2017, DOI. 10.1007/s 11661-017-4020-2) may not apply to steels with manganese greater than 15 wt. %. A maximum carbon content in the austenite is predicted for Alloy 2. Alloy 3 has almost no carbon in the austenite formed during batch annealing as a result of the elevated chromium content and $M_{23}(C,N)_6$ precipitation. This alloy also had the lowest bulk carbon chemistry.

Figure 12A:
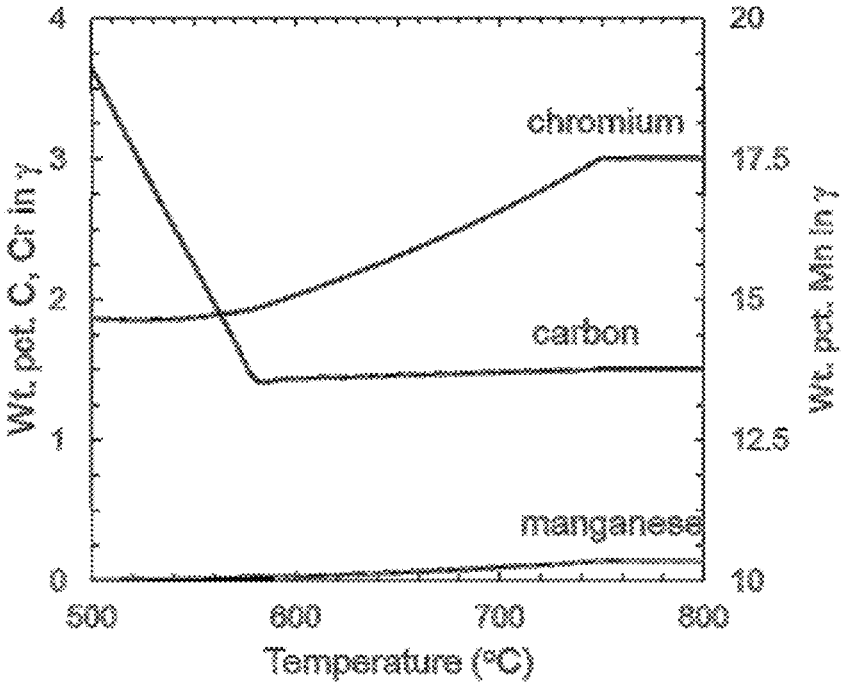
FIG. 12A is a chart showing an example calculation of the composition of γ-austenite in Alloy 2, where at the lower annealing temperature austenite becomes enriched in Mn but where due to the formation of carbides, carbon and chromium are lost.
Figure 12B:
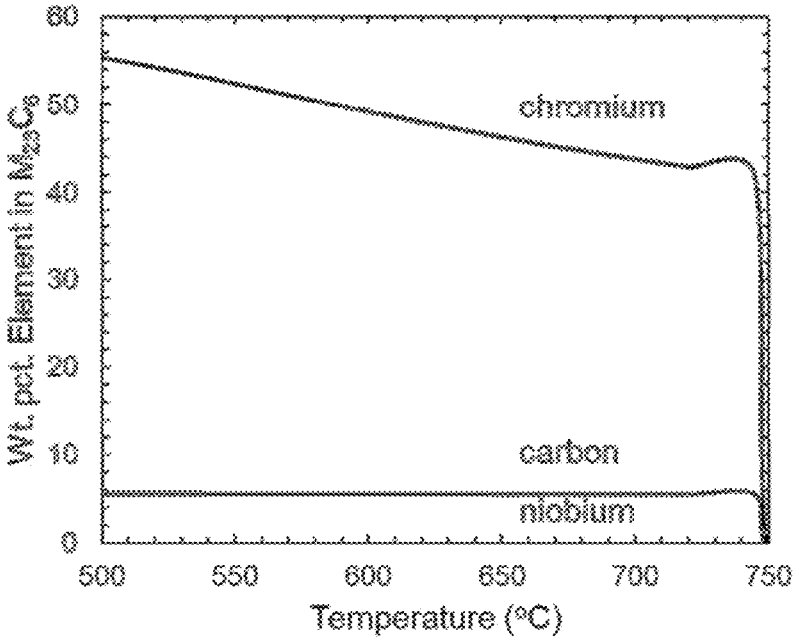
FIG. 12B is a chart showing an example calculation of the composition of $M_{23}(C,N)_6$ in Alloy 2, where at the lower annealing temperature the $M_{23}(C,N)_6$ becomes enriched in chromium.
Figure 12C:
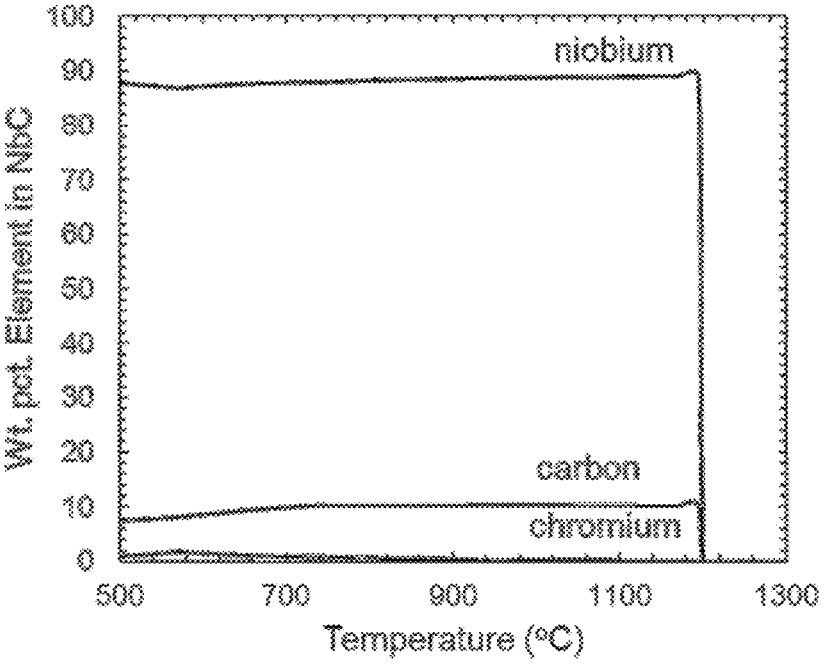
FIG. 12C is a chart showing an example calculation of the composition of NbC in Alloy 2.
Figure 12D:
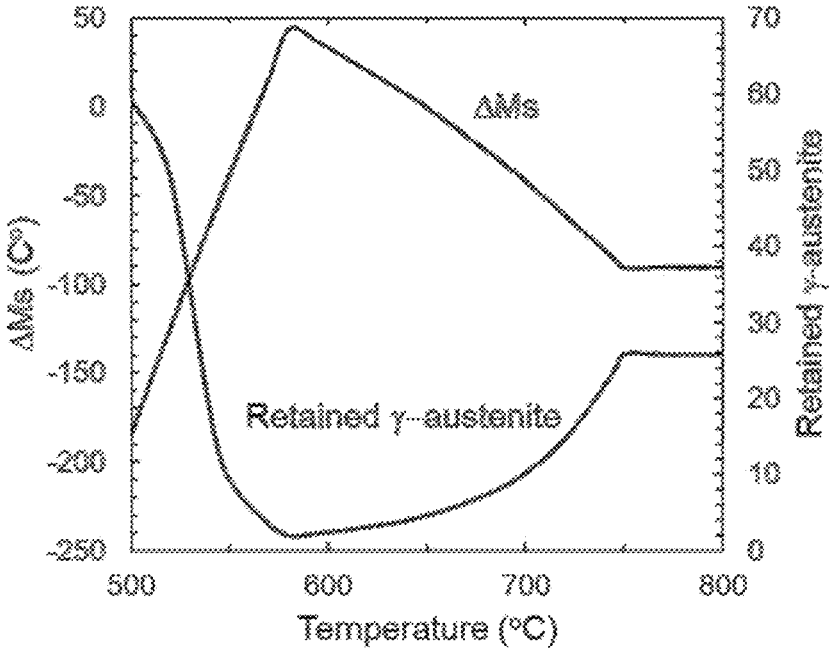
FIG. 12D is a chart showing the recalculated ΔMs and expected retained γ-austenite at room temperature with process temperature.

Phase chemistry for γ-austenite, NbC, and $M_{23}(C,N)_6$ as a function of process temperature is shown in FIGS. 12A-12C for Alloy 2. The γ-austenite loses both Cr, and C at lower annealing temperatures (<750° C.) as shown in FIG. 12A. It should be noted that both Cr and C are important elements for the SFE of the designed alloys. FIG. 12D shows the effect of annealing temperature on the ΔMs and the expected volume fraction retained γ-austenite based on the composition predicted by the FactSage 7.0™ software calculations. Values suggested for the ΔMs are only relative and the weight fraction of retained γ-austenite should be greater than what is calculated from FIG. 11. A higher processing temperature may be necessary to reduce the amount of Mn partitioning, which may encourage the desired two-stage TRIP behavior.

Figures 13, 14:
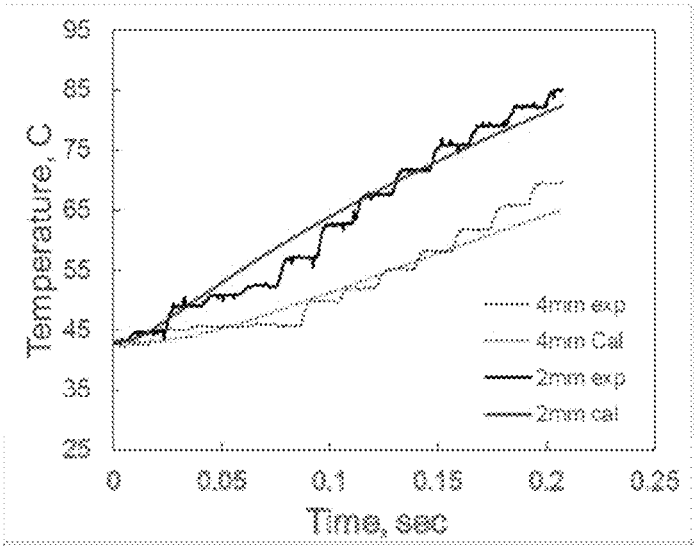
FIG. 13 is a table showing a composition and calculated thermodynamic parameters for the cast alloys, where SFE was calculated according to a homogeneous single phase γ-austenite.
FIG. 14 is a chart showing an estimated heat flux that provides well matched temperature curves between the experiments and calculations using data from dip #3.

Two alloys were investigated, the first alloy being Alloy 2 and the second alloy being Alloy 2 with an addition of aluminum. The chemistry according to optical emission spectroscopy with carbon and nitrogen determined by LECO combustion analysis is shown in FIG. 13 with calculated thermodynamic parameters for a fully austenitic microstructure.

These alloys were further evaluated for twin roll strip casting and the formation of thin metal strips, which included the performance of dip testing. These dip tests were performed while melting Alloy 2 (referred to as "Cr" (by weight, 0.17% carbon, 13.9% manganese, 1.1% silicon, 3.3% chromium, 0.042% niobium, with the balance being iron) in a 200 pounds (lbs) coreless induction furnace. Copper block (with a surface roughness of Ra 14 μm) was used for these dip tests. Two thermocouples were placed in the block at a distance of 2 mm and 4 mm from the contact surface individually. Dip speed was set at 1.5 m/s. At this speed, the copper block was submerged into the liquid steel for 0.2 second. After each dip, the temperature curves of the copper block were transferred to a heat flux calculator to inversely estimate the average heat flux across the liquid steel and copper block interface during the 0.2 seconds. A comparison of the experimental and calculated curves shown in FIG. 14 provides a close fit between the curves.

Three (3) dips were performed for various chemistry and covering gas. Dip #1 was performed under an argon (Ar) gas cover while Dip #2 and Dip #3 were each performed under $N_2$ (nitrogen) gas cover. Ferro-chrome was added after Dip #2 to study the effect of Cr addition on the heat flux. Parameters for three (3) dips are shown in FIG. 15. In general, the heat flux employed during these tests was generally comparable to heat fluxes observed during twin roll strip casting. With regard to the gas covers, the use of $N_2$ gas cover provides a greater heat flux while the addition of Cr to the alloy is estimated to increase the heat flux by 20%.

Figure 16A:
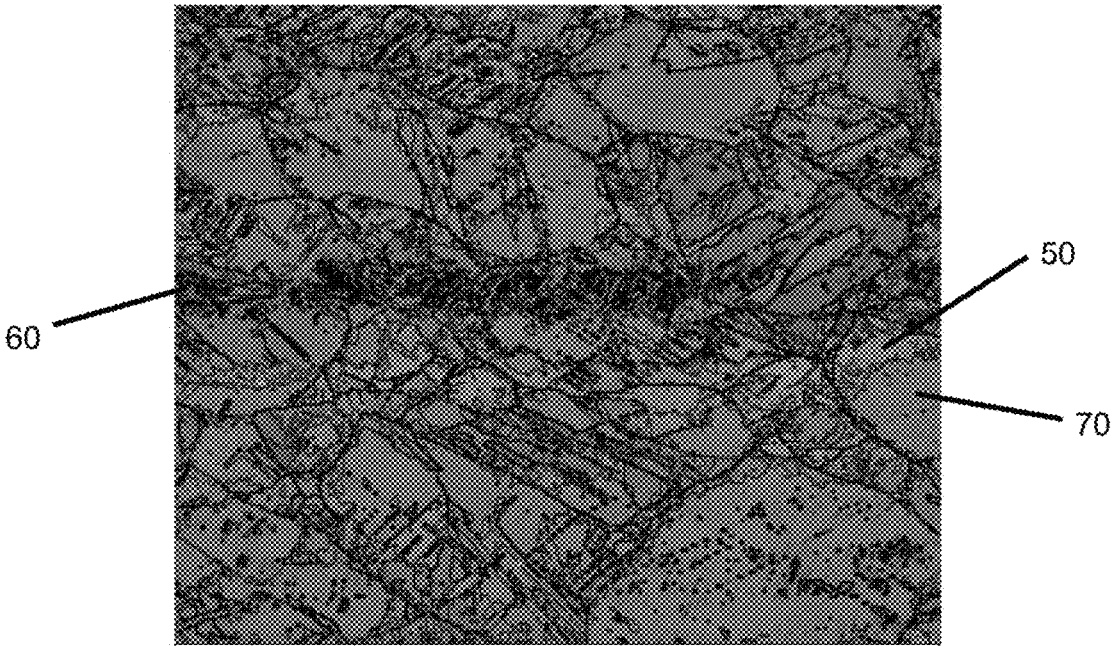
FIG. 16A is an image taken under magnification showing hot band EBSD-OIM map of the Cr alloy microstructure, showing γ-austenite 50 as green (more lightly shaded when shown in black & white/grayscale), ε-martensite 70 as red (moderately shaded when shown in black & white/grayscale), and α-martensite 60 as blue (more darkly shaded when shown in black & white/grayscale), where ε-martensite as shown is most notably prevalent and is significantly larger than γ-austenite and α-martensite, and where a very minor presence of α-martensite is shown as a small band extending laterally across the image slightly above center, α-martensite being sized on average smaller than ε-martensite and γ-austenite, the image including a micron marker (a black bar) indicating a reference distance of 20 microns within the image.
Figure 16B:
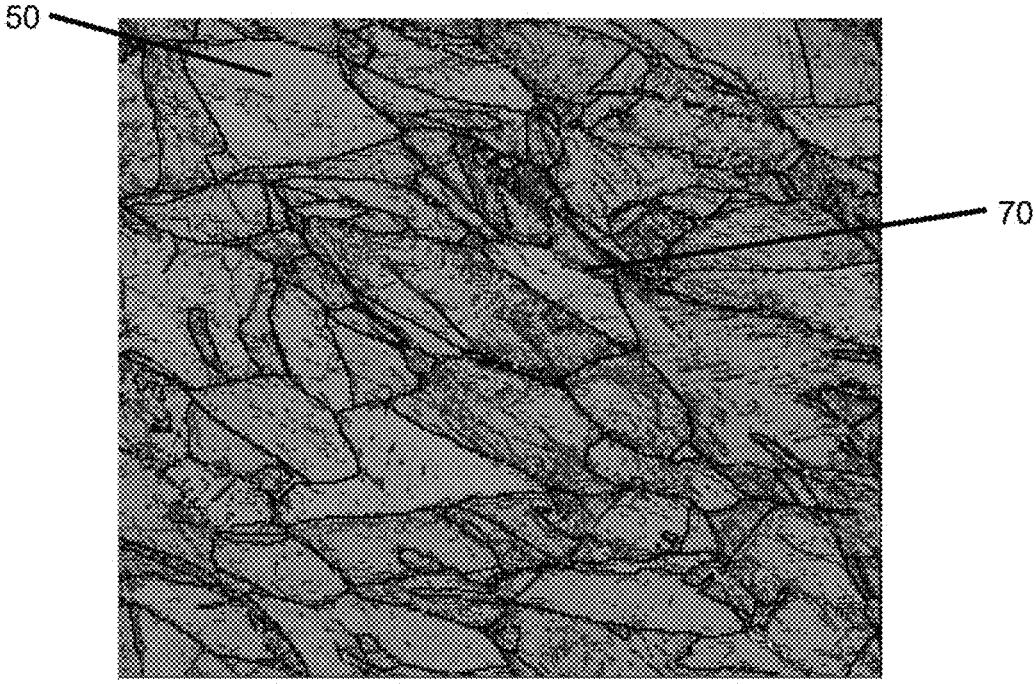
FIG. 16B is an image taken under magnification showing hot band EBSD-OIM map of the Cr+Al alloy microstructure, showing γ-austenite 50 as green (more lightly shaded when shown in black & white/grayscale) and ε-martensite 70 as red (more moderately shaded when shown in black & white/grayscale), where γ-austenite as shown is most notably prevalent and is significantly larger than ε-martensite, whose presence is very limited and sparse, the image including a micron marker (a black bar) indicating a reference distance of 20 microns within the image.
Figures 16C, 17:
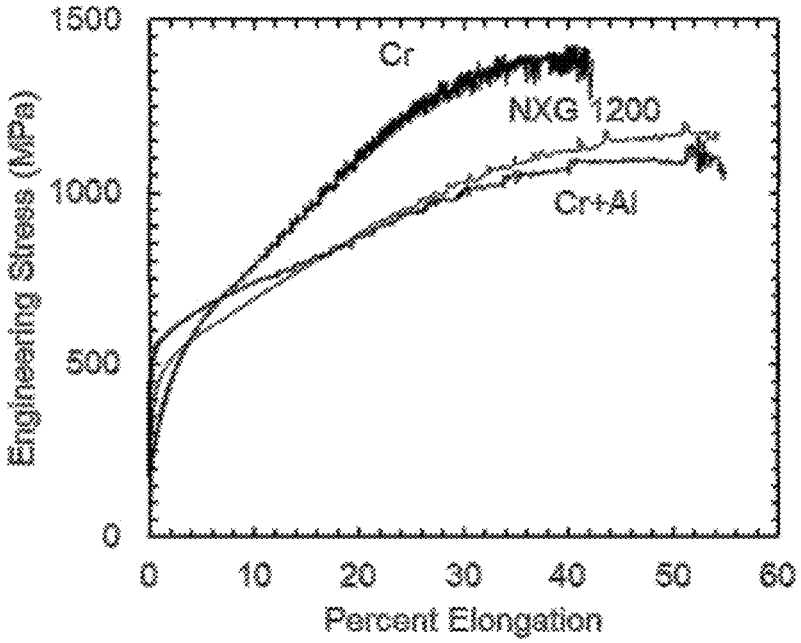
FIG. 16C is a stress-strain graph for the hot band alloys with the NXG1200™ alloy reported by NanoSteel for comparison.
FIG. 17 is a table showing the average mechanical properties of the hot band alloys with a 68% standard deviation determined from two samples.

To initially evaluate these alloys without the added expense of strip casting, casting and milling of the steel was performed to obtain billets of 6.86 cm×6.86 cm×19.05 cm (2.7 in×2.7 in×7.5 in). Hot rolling was performed in three stages, breakdown, roughing, and finishing, to obtain a total hot reduction of 97%. Breakdown of the 6.86 cm (2.7 in) thick block was performed at 1250° C. (2282° F.) to solutionize the NbC and the billet was reduced to a 2.54 cm (1 in) thick plate. Roughing was performed at 1100° C. (2012° F.) to reduce the plate to 1.27 cm (0.5 in), and finishing occurred at 950° C. (1742° F.) to the final hot band thickness of 0.22 cm (0.086 in). Hot band materials exited the rolling mill at approximately 800° C. (1472° F.). Once the final gauge thickness was obtained, cooling to room temperature was performed by placing the hot band between two thermal insulating blankets. Electron backscattered diffraction was conducted and analyzed using OIM Analysis™ to generate EBSD-OIM maps of the hot band microstructure, which are shown in FIGS. 16A and 16B, while mechanical properties of the hot band steel were determined, as shown in FIG. 16C. It is noted by comparing the micrographs shown in FIGS. 16A and 16B that the Cr alloy shown in FIG. 16A has a significantly increased volume fraction of ε-martensite compared to the Cr+Al alloy shown in FIG. 16B. This difference can be rationalized by the difference in the $Ms^{\varepsilon}$ temperatures from FIG. 13 which shows that the $Ms^{\varepsilon}$ temperature of the Cr+Al alloy is less than 0° C. coupled with very little athermal ε-martensite observed in FIG. 16B. The higher volume fraction of γ-austenite in the hot band steel translates to a greater volume fraction of transformable product and is related to an increased total ductility of the steel (54% vs. 43%, respectively). A summary of mechanical properties for the hot band alloys is shown in FIG. 17.

Figure 18A:
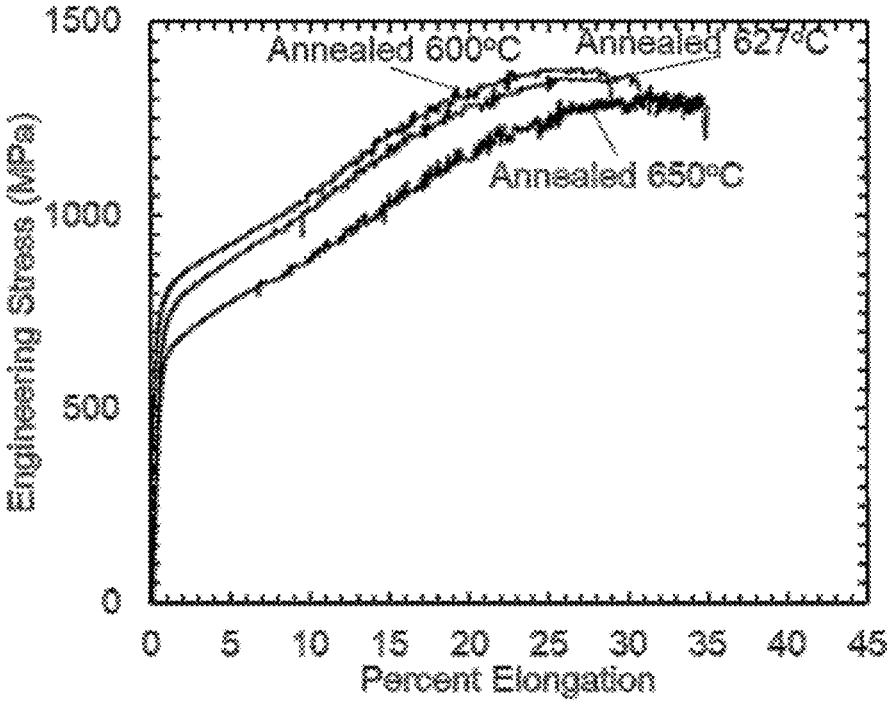
FIG. 18A is a stress-strain graph of the Cr alloy after cold rolling and annealing at varying temperatures for 20 hours.
Figure 18B:
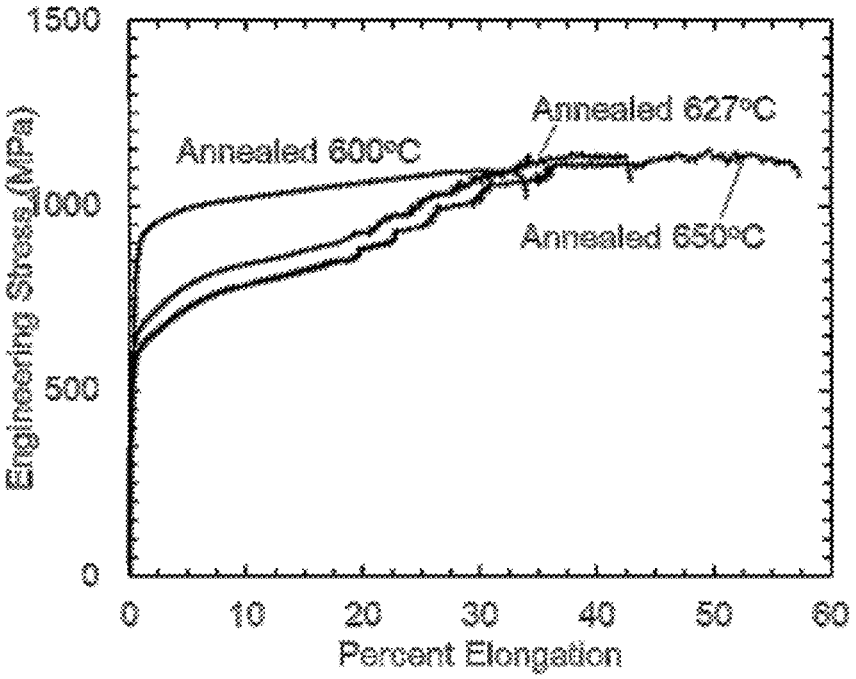
FIG. 18B is a stress-strain graph of the Cr+Al alloy after cold rolling and annealing at varying temperatures for 20 hours.
Figure 20A:
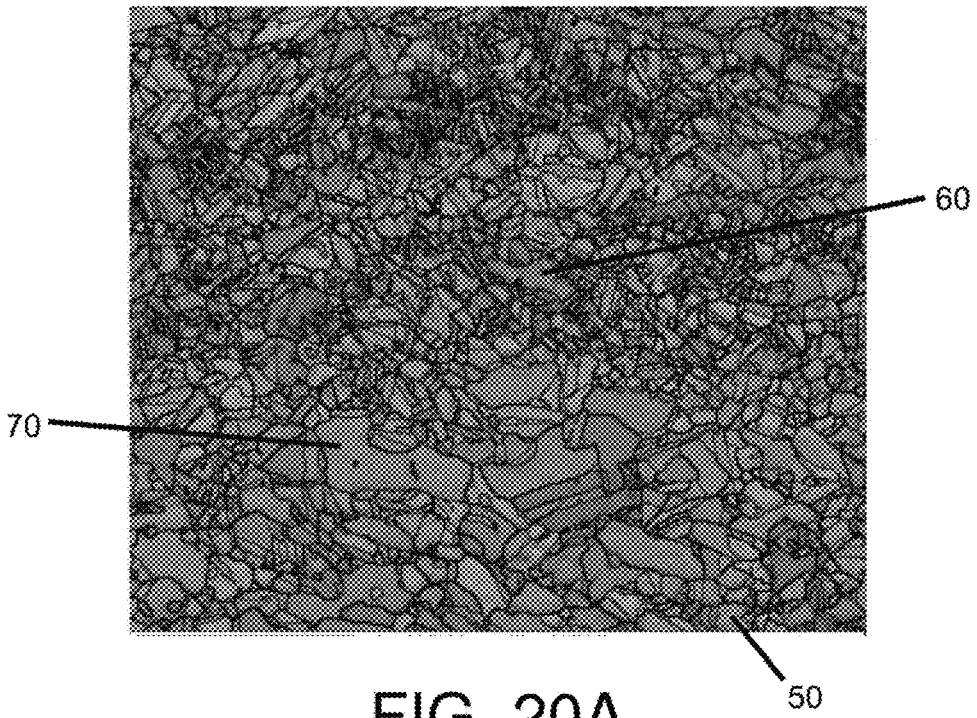
FIG. 20A is an image taken under magnification showing cold rolled and annealed EBSD-OIM map of the Cr alloy microstructure at 600° C., showing γ-austenite grains 50 as green (more lightly shaded when shown in black & white/grayscale), ε-martensite 70 as red (more moderately shaded when shown in black & white/grayscale), and α-ferrite/martensite 60 as blue (more darkly shaded when shown in black & white/grayscale), where ε-martensite as shown is significantly larger than γ-austenite and α-ferrite/martensite, and where a very minor presence of α-ferrite/martensite is shown as two bands extending laterally across the image near the top and near the middle of the image, the image including a micron marker (a black bar) indicating a reference distance of 10 microns within the image.
Figure 20B:
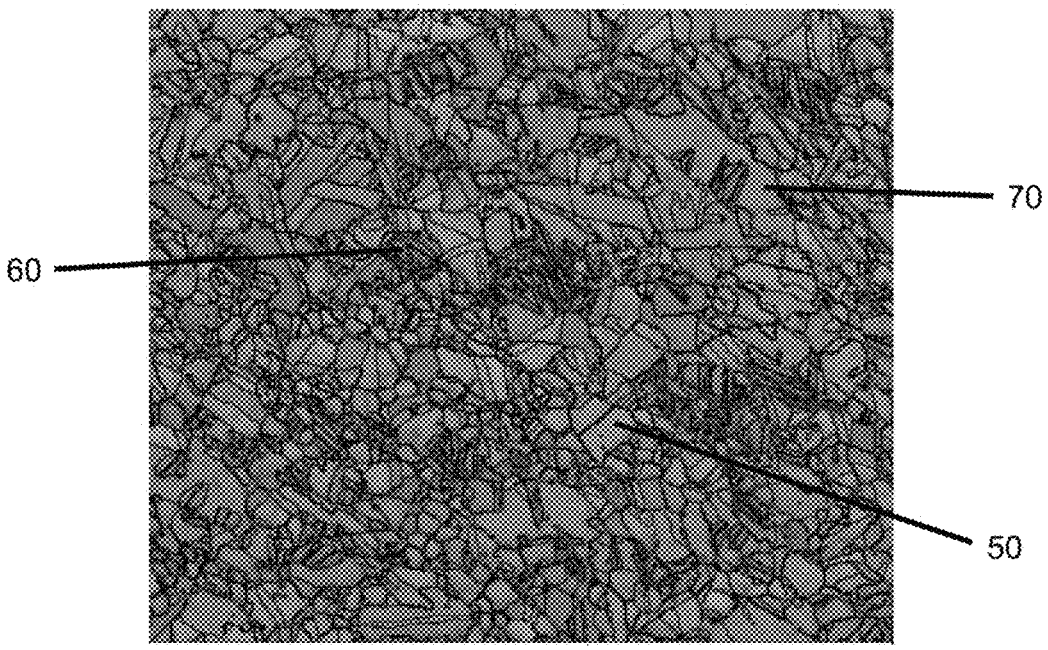
FIG. 20B is an image taken under magnification showing cold rolled and annealed EBSD-OIM map of the Cr alloy microstructure at 650° C., showing γ-austenite grains 50 as green (more lightly shaded when shown in black & white/grayscale), ε-martensite 70 as red (more moderately shaded when shown in black & white/grayscale), and α-ferrite/martensite 60 as blue (more darkly shaded when shown in black & white/grayscale), where γ-austenite and ε-martensite as shown are most notably prevalent and where α-ferrite/martensite is on average smaller than γ-austenite and ε-martensite as shown, the image including a micron marker (a black bar) indicating a reference distance of 10 microns within the image.
Figure 20C:
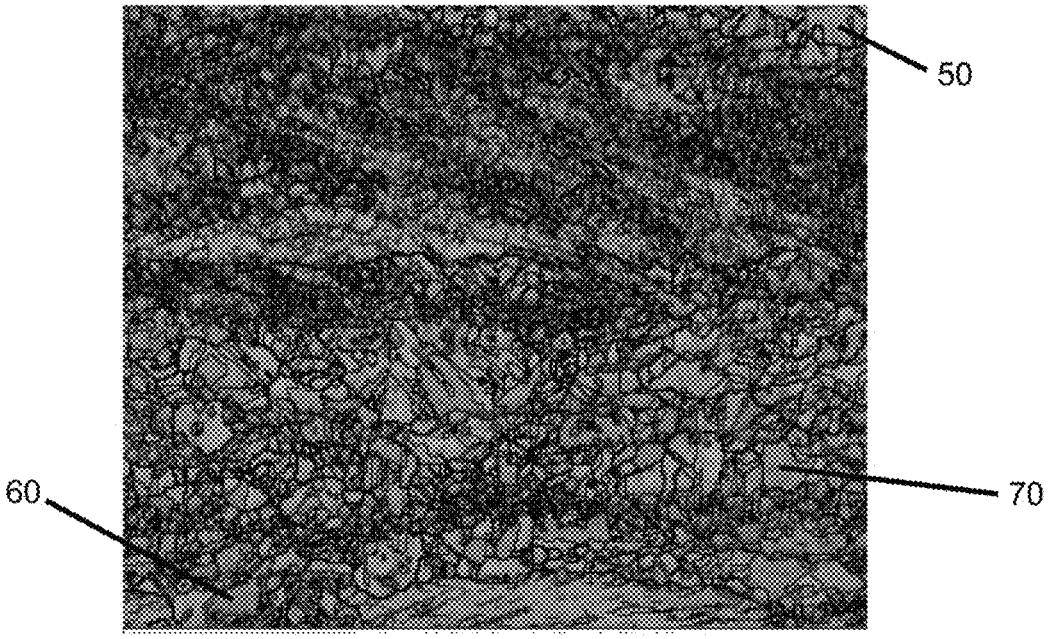
FIG. 20C is an image taken under magnification showing cold rolled and annealed EBSD-OIM map of the Cr+Al alloy microstructure at 600° C., showing γ-austenite grains 50 as green (more lightly shaded when shown in black & white/grayscale), ε-martensite 70 as red (more moderately shaded when shown in black & white/grayscale), and α-ferrite/martensite 60 as blue (more darkly shaded when shown in black & white/grayscale), where α-ferrite/martensite is shown primarily in bands extending laterally across the image and is on average smaller in size than γ-austenite and ε-martensite as shown, the image including a micron marker (a black bar) indicating a reference distance of 10 microns within the image.
Figure 20D:
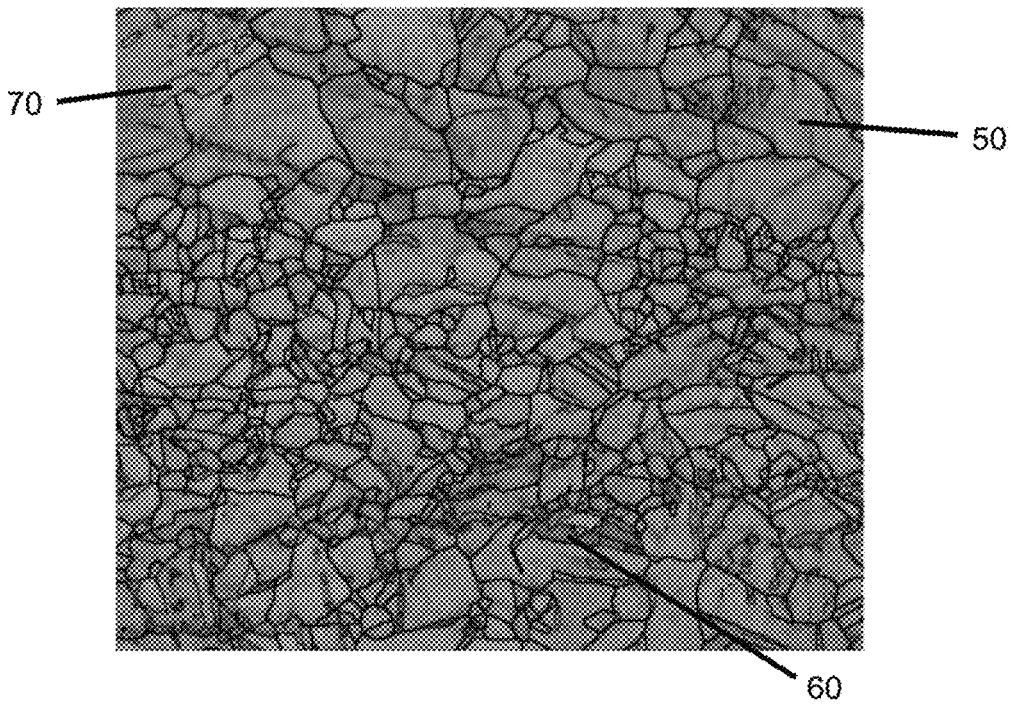
FIG. 20D is an image taken under magnification showing cold rolled and annealed EBSD-OIM map of the Cr+Al alloy microstructure at 650° C., showing γ-austenite grains 50 as green (more lightly shaded when shown in black & white/grayscale), ε-martensite 70 as red (more moderately shaded when shown in black & white/grayscale), and α-ferrite/martensite 60 as blue (more darkly shaded when shown in black & white/grayscale), where γ-austenite as shown is most notably prevalent and is significantly larger than ε-martensite and α-ferrite/martensite, the image including a micron marker (a black bar) indicating a reference distance of 10 microns within the image.
Figure 21:
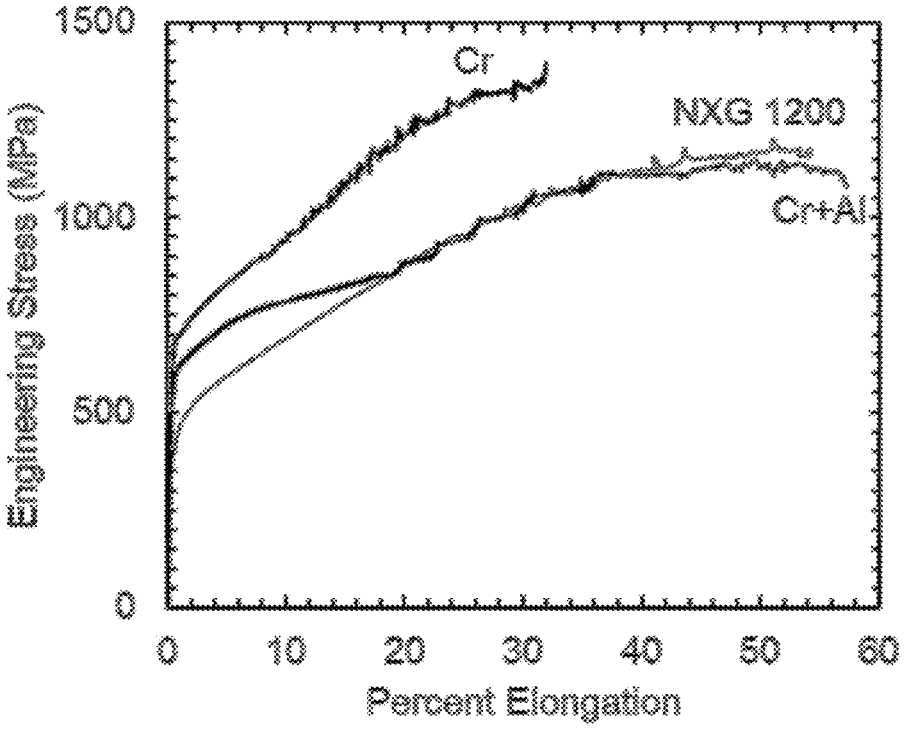
FIG. 21 is a graph comparing the 650° C. batch annealed materials (associated with FIGS. 20B and 20D) together with NXG1200™.

After formation of the cooled hot band, cold rolling was performed followed by annealing to obtain a final product having certain microstructure and material properties. Cold rolling was performed using a Stanat rolling mill in the 4-high configuration to obtain a cold reduction of 50±3%. Annealing was performed at different temperatures using batch annealing furnaces operated at 600° C., 628±1° C., and 650° C. (1112, 1162, and 1202° F.) for 20 hours followed by a furnace cool for a cooling time of ~25 hours to 50° C. (122° F.). Stress-strain graphs of the Cr and Cr+Al alloys are shown in FIGS. 18A and 18B, respectively, where the engineering stress (as opposed to the true stress) and percent elongation for each are plotted. A summary of certain material properties for each alloy are also provided in FIG. 19, which includes yield strength (YS), ultimate tensile strength (UTS), % elongation, strength coefficient (K), and strain hardening exponent (n). The Cr alloy after batch annealing at 650° C. does not exhibit necking. It is interesting to note that the dynamic strain aging (DSA) response of both alloys is significant for all conditions with the exception of Cr+Al after the 600° C. annealing, as evidenced by the relative variation in material properties shown. To better understand this response EBSD-OIM microstructural analysis was performed on the 600° C. and 650° C. as shown in FIGS. 20A-20D. It is noted that for the Cr and Cr+Al alloys at 650° C. that a low temperature austenitization had been performed with athermal α and ε-martensite forming upon cooling. With reference to FIGS. 20B and 20D, the absence of α-ferrite grains observed in both alloys indicates that the batch annealing temperature of 650° C. was above the $Ac_3$. For the Cr alloy, a low temperature austenitization could also be obtained at a temperature as low as 600° C. and is corroborated by the similar mechanical responses and strengths as shown in FIG. 18A. However, with reference to FIG. 21C, at 600° C. the Cr+Al alloy appears to be partially recrystallized and there is some α-ferrite forming on slip bands in the structure. A comparison of the two alloys with NXG™ 1200 (NXG1200) is shown in FIG. 21 for materials batch annealed at 650° C., where the engineering stress (as opposed to the true stress) and percent elongation for each are plotted.

Figure 22A:
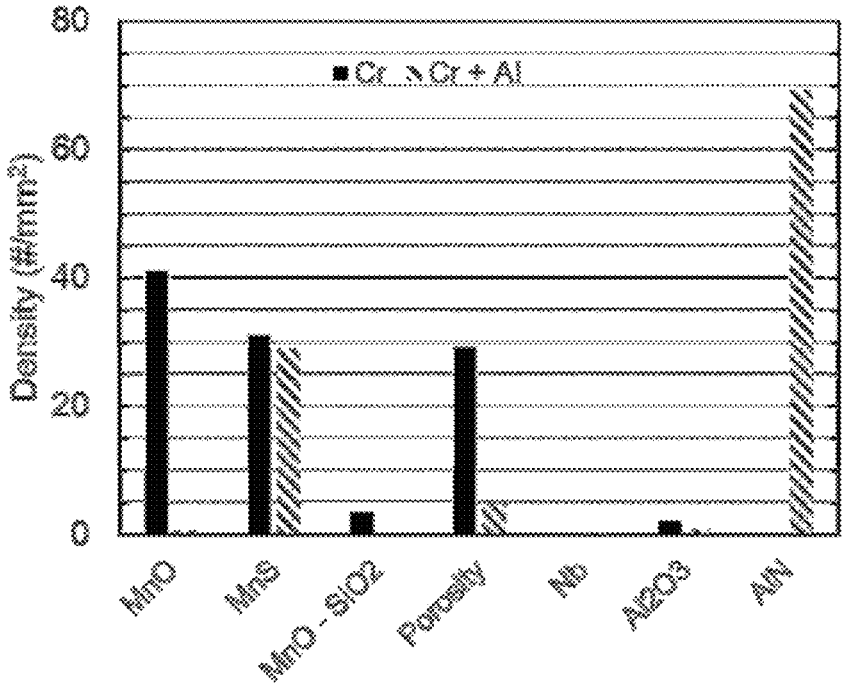
FIG. 22A is a chart showing the inclusion density of the as-cast Cr and Cr+Al alloys.
Figure 22B:
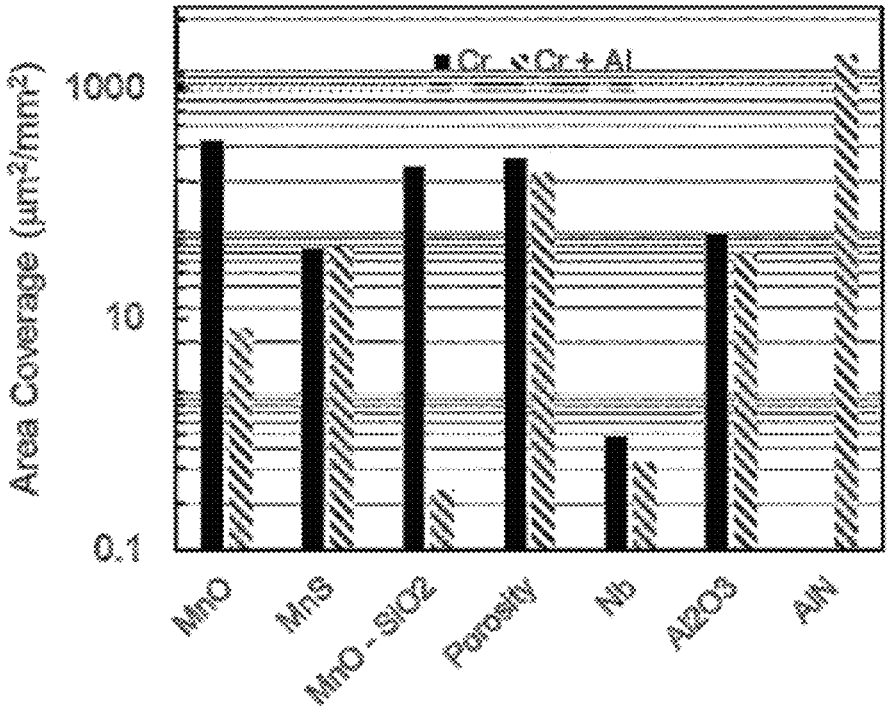
FIG. 22B is a chart showing the area coverage of the as-cast Cr and Cr+Al alloys.

To understand the lack of necking observed in the Cr alloy, inclusion analysis was performed using the automated ASPEX analysis feature of the as-cast material. The inclusion density and area coverage are shown in FIGS. 22A and 22B, respectively, for each of the Cr alloy and the Cr+Al alloy, and it is noted that the data for the area coverage is graphed on a log-scale. In these figures, it is observed that the Cr+Al alloy with the increased N concentration (0.033 ppm N) has a significantly higher density and area coverage of AlN inclusions. When comparing the porosity of the cast materials, the Cr+Al alloy has a lower density of pores but the area coverage of the porosity of the two alloys are very similar (244 ppm Cr, vs. 183 ppm Cr+Al). This would indicate that the Cr+Al alloy has fewer pores but the average pore size is larger in the Cr+Al alloy. The Cr alloy has a significantly higher density and area coverage of MnO and $MnO+SiO_2$ inclusions, which is due to the reduced concentration of aluminum. It is interesting to note that both alloys have comparable $Al_2O_3$ and MnS inclusion populations. The Al in the Cr alloy was not added intentionally and is potentially due to trace element pickup from the charge material or refractory materials. Presence of MnO and $MnO—SiO_2$ in the Cr alloy and AlN inclusions in the Cr+Al alloy appear to be the most significant differences between the two steels.

While any such sheet contemplated herein may be formed by any method and using any mechanism(s), in certain exemplary instances, the sheets are cast. It is further appreciated that any desired casting operation may be employed. For example, a twin roll casting process using a twin roll caster may be employed. The use of a twin roll casting process is advantageous for forming thin metal strip products using the TRIP alloys described herein which are substantially free of aluminum. Certainly, the twin roll casting process provides an economical benefit by efficiently generating a thin metal strip having an as-cast near net shape. What this means is that while other processes may require significant reduction of the as-cast thickness of a sheet well over 50% before reaching its final, cooled thickness, the twin roll casting process forms a thin metal strip that is substantially or relatively close to its final cooled thickness. In such instances, no more than a 40% reduction in the as-cast thickness may be required. Also, because these substantially aluminum-free TRIP alloy are difficult to cold roll, hot rolling is easily performed immediately after formation of the thin metal strip from a twin roll caster. Additionally, the twin roll casting process is able to achieve thin metal strips having improved properties when employing these substantially aluminum-free TRIP alloys.

By example, an exemplary twin roll casting process is further described, and includes:

(1) assembling a pair of counter-rotatable casting rolls having casting surfaces laterally positioned to form a gap at a nip between the casting rolls through which a thin metal strip having an as-cast thickness of less than 3 mm or less than 2 mm can be cast, (2) assembling a metal delivery system adapted to deliver molten metal above the nip to form a casting pool, the casting pool being supported on the casting surfaces of the pair of counter-rotatable casting rolls and confined at the ends of the casting rolls, (3) delivering a molten steel to the metal delivery system;

(4) delivering the molten metal from metal delivery system above the nip to form the casting pool; and (5) counter rotating the pair of counter-rotatable casting rolls to form metal shells on the casting surfaces of the casting rolls that are brought together at the nip to deliver the thin metal strip downwardly, the thin metal strip (or more broadly, sheet) having an as-cast thickness less than 3 mm or less than 2 mm.

It is appreciated that the molten metal employed in the methods, as with the resulting thin metal strip or sheet, may form any of a variety of steel alloys contemplated herein.

Figure 1:
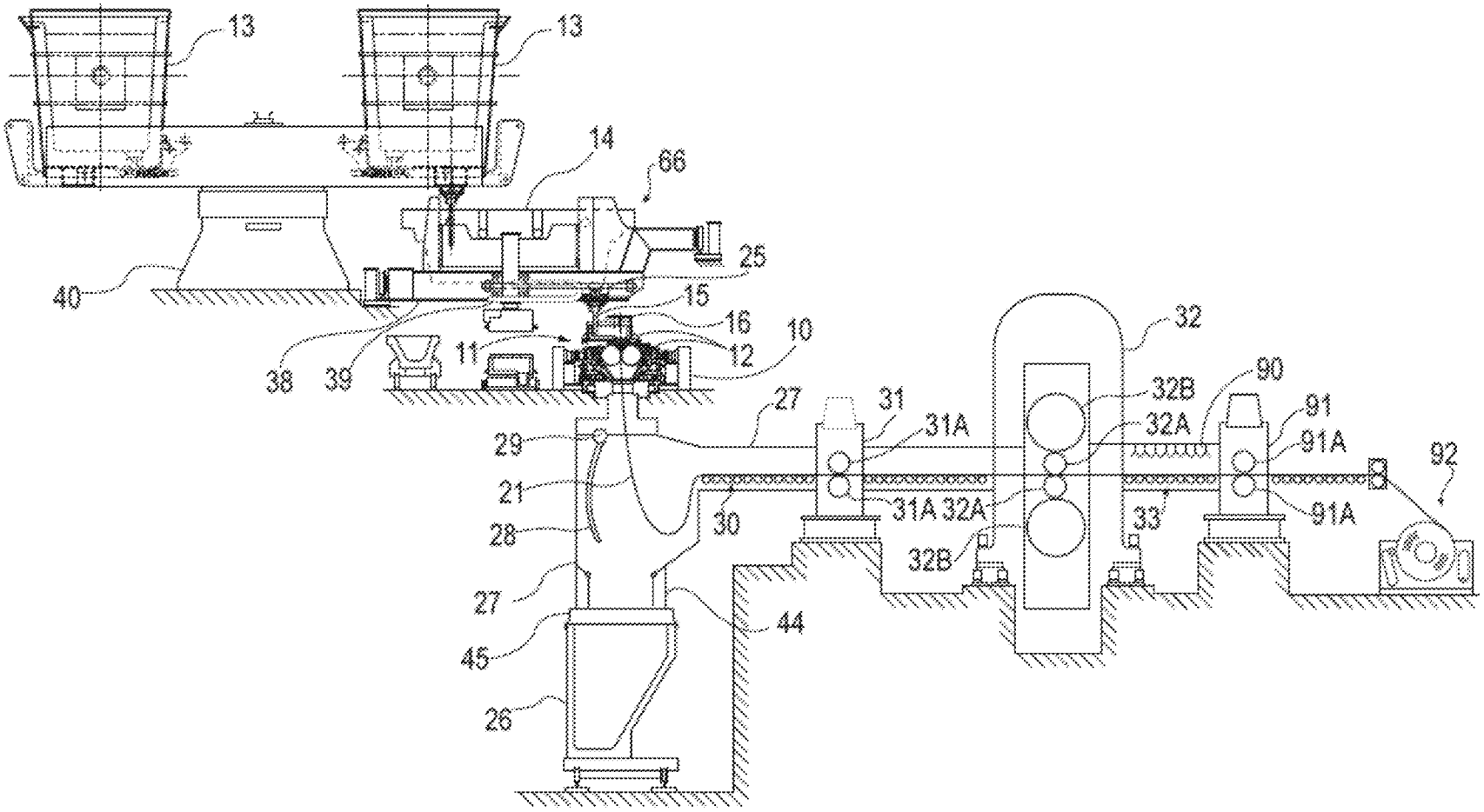
FIG. 1 is a diagrammatical side view of a twin roll caster plant in accordance with one or more aspects of the present invention.
Figure 2:
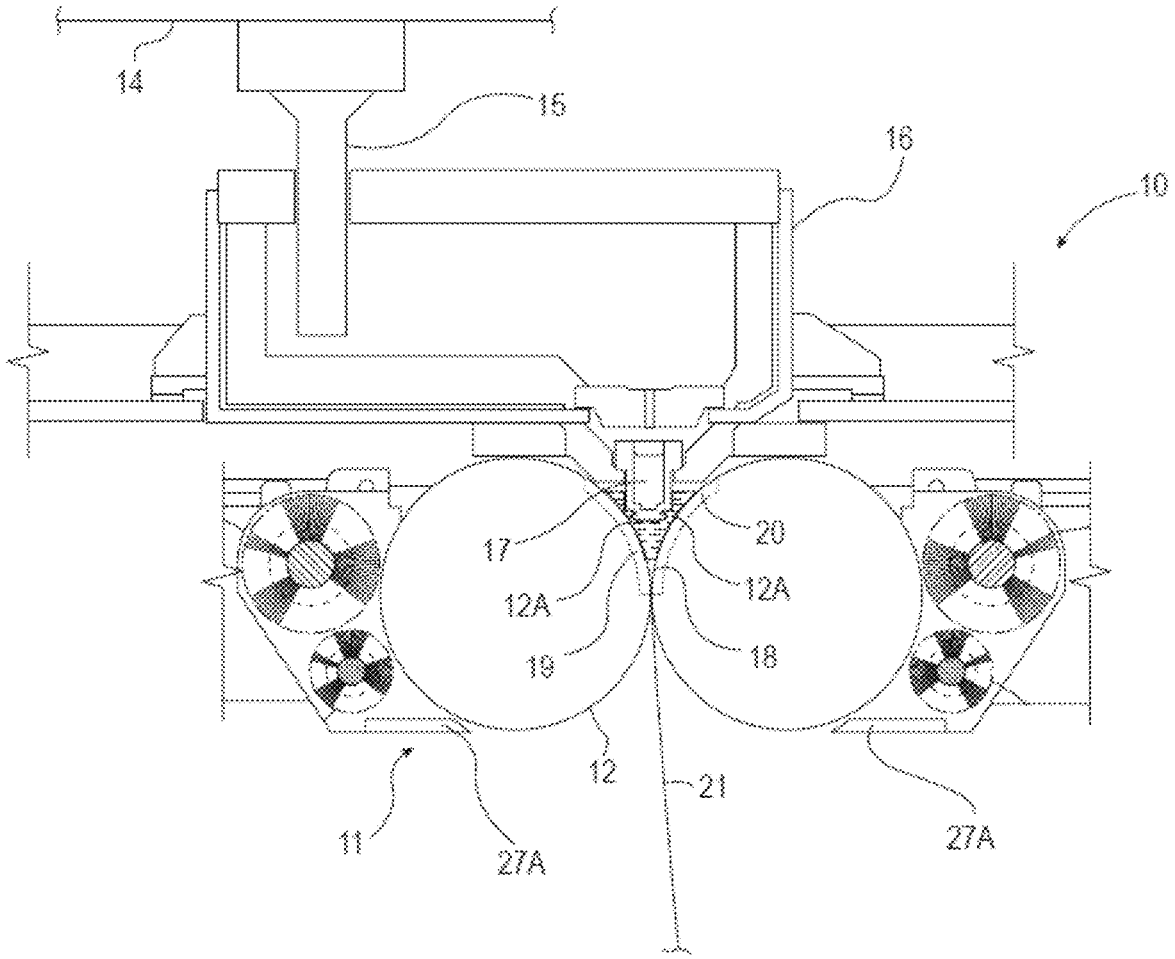
FIG. 2 is a partial sectional view through the casting rolls mounted in a roll cassette in the casting position of the caster of FIG. 1, in accordance with one or more aspects of the present invention.

In one example, with reference to FIGS. 1 and 2, an exemplary strip casting system is shown. In this embodiment, the strip casting system is a continuous twin roll casting system. The twin roll caster comprises a main machine frame 10 that stands up from the factory floor and supports a roll cassette module 11 including a pair of counter-rotatable casting rolls 12 mounted therein. The casting rolls 12 having casting surfaces 12A that are laterally positioned to form a nip 18 there between. Molten metal is supplied from a ladle 13 through a metal delivery system, which includes a movable tundish 14 and a transition piece or distributor 16. From the distributor 16, molten metal flows to at least one metal delivery nozzle 17 (also referred to as a core nozzle) positioned between the casting rolls 12 above the nip 18. Molten metal discharged from the delivery nozzle 17 forms a casting pool 19 of molten metal supported on the casting surfaces 12A of the casting rolls 12 above the nip 18. This casting pool 19 is laterally confined in the casting area at the ends of the casting rolls 12 by a pair of side closures or plate side dams 20 (shown in dotted line in FIG. 2). The upper surface of the casting pool 19 (generally referred to as the "meniscus" level) typically rises above the bottom portion of the delivery nozzle 17 so that the lower part of the delivery nozzle 17 is immersed in the casting pool 19. The casting area above the casting pool 19 provides the addition of a protective atmosphere to inhibit oxidation of the molten metal before casting.

The ladle 13 typically is of a conventional construction supported on a rotating turret 40. For metal delivery, the ladle 13 is positioned above a movable tundish 14 in the casting position as shown in FIG. 1 to deliver molten metal to movable tundish 14. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position. An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

With reference to FIG. 2, the casting rolls 12 are internally water cooled so that as the casting rolls 12 are counter-rotated, shells solidify on the casting surfaces 12A as the casting rolls move into and through the casting pool 19 with each revolution of the casting rolls 12. This solidification is rapid, which is exemplified by the heat fluxes described below (being greater than 10 $MW/m^2$). The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip. In one embodiment, the casting rolls 12 may be configured to provide a gap at the nip 18 through which thin cast strip 21 less than 5 mm in thickness can be cast. Counter rotating the casting rolls 12 to form metal shells on the casting surfaces 12A of the casting rolls 12 may occur, for example, at a heat flux greater than 10 $MW/m^2$.

With continued reference to FIG. 1, at the start of the casting campaign, a short length of imperfect strip is typically produced as casting conditions stabilize. After continuous casting is established, the casting rolls 12 are moved apart slightly and then brought together again to cause the leading end of the thin strip to break away forming a clean head end for the following strip to cast. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the strip 21 onto the guide table 30 and feed the strip 21 through the pinch roll stand 31. The apron 28 is then retracted back to the hanging position to allow the strip 21 to hang in a loop beneath the casting rolls in enclosure 27 before the strip passes to the guide table 30 where it engages a succession of guide rollers.

The sealed enclosure 27 is formed by a number of separate wall sections that fit together with seal connections to form a continuous enclosure that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be completely sealed so as to prevent atmospheric leakage, but rather may provide a less than perfect seal appropriate to allow control and support of the atmosphere within the enclosure as desired with some tolerable leakage.

With continued reference to FIG. 1, a rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the strip 21.

With reference now to both FIGS. 1 and 2, the enclosure 27 may include an upper collar portion 27A supporting a protective atmosphere immediately beneath the casting rolls in the casting position. When the casting rolls 12 are in the casting position, the upper collar portion is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

After the thin metal strip or sheet is formed (cast) using any desired process, such as the strip casting process described above in conjunction with FIGS. 1 and 2, the strip is hot rolled and cooled to form a desired thin metal strip or sheet having desired microstructure and material properties. After hot rolling, any heat treatment may also be employed.

With regard to hot rolling, while various amounts of hot reduction may be achieved (that is, a reduction in the thickness of the as-cast strip), in certain instances up to 40% reduction may be achieved. In other instances, hot reduction of 20% to 40% is achieved using the hot rolling mill. For the different TRIP alloys described herein, it is advantageous to hot roll these alloys in lieu of cold rolling, as cold rolling would prove difficult and could cause the material properties of the strip to significantly increase (jump), which is undesirable. However, cold rolling up to 30% reduction (or in certain instances 20% to 30% cold reduction) may be performed. It is also conceived of performing both hot and cold rolling to achieve a final strip having a final reduced thickness, where after hot rolling (hot reduction), cold reduction is performed by cold rolling.

Exemplary hot rolling and cooling may be performed in any desired manner. For example, referring again to the exemplary embodiment shown in FIG. 1, a thin cast steel strip 21 is shown passing from the casting rolls after formation/casting and across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. It is appreciated that one pair or multiple pairs of work rolls may be employed. Work rolls and rolling mills are distinguishable from pinch rolls, where a pair of work rolls apply sufficient forces to more substantially reduce the thickness of the strip while pinch rolls are employed to "grip" the strip to impart tension to control the translation of the strip. Much lower forces are applied to the strip by way of pinch rolls, and while these forces may still reduce the thickness of the strip, this reduction is substantially less than the reduction generated by work rolls.

After exiting the hot rolling mill 32, the hot rolled cast strip then passes onto a run-out table 33, where the strip may be cooled by contact with a coolant, such as water, supplied via water jets 90 or other suitable means, and by convection and radiation. In particular instances such as shown, the hot rolled strip may then pass through a second pinch roll stand 91 having rollers 91A to provide tension on the strip, and then to a coiler 92. The thickness of strip may be between about 0.3 and about 3 millimeters in thickness after hot rolling in certain instances, while other thicknesses may be provided as desired.

The strip 21 is passed through the hot mill to reduce the as-cast thickness before the strip 21 is cooled. In particular instances, the hot solidified strip (the cast strip) is passed through the hot mill while at an entry temperature greater than 1050° C., and in certain instances up to 1150° C. After the strip 21 exits the hot mill 32, the strip 21 is cooled. Cooling may be achieved by any known methods using any known mechanism(s), including those described above. In certain instances, the cooling is sufficiently rapid to avoid the onset of appreciable ferrite, which is also influenced by composition.

In view of the foregoing, the following identifies certain specific embodiments of the subject matter described and/or shown herein, which may be expanded or narrowed as desired. In one specific embodiment, a method of forming a TRIP steel thin metal strip comprises:

- providing and/or assembling a pair of counter-rotatable casting rolls having casting surfaces laterally positioned to form a gap at a nip between the casting rolls through which a thin metal strip having an as-cast thickness of less than 3 mm can be cast;
- providing and/or assembling a metal delivery system adapted to deliver molten metal above the nip to form a casting pool, the casting pool being supported on the casting surfaces of the pair of counter-rotatable casting rolls and confined at the ends of the casting rolls;
- delivering a molten steel to the metal delivery system;
- delivering the molten metal from metal delivery system above the nip to form the casting pool; and
- counter rotating the pair of counter-rotatable casting rolls to form metal shells on the casting surfaces of the casting rolls that are brought together at the nip to deliver the thin metal strip downwardly, the thin metal strip having an as-cast thickness less than 3 mm, the thin metal strip being formed of a steel alloy composition comprising:

by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting.

In another embodiment of the above the composition includes by weight up to 0.05% (0.02%) nitrogen.

In an embodiment of each of the above the composition includes by weight up to 0.1% niobium.

In an embodiment of each of the above the sheet includes γ-austenite as a single phase microstructure.

In an embodiment of each of the above the sheet includes γ-austenite as a tri-phase microstructure.

In an embodiment of each of the above the composition includes $M_{23}(CN)_6$ and/or NbC.

In an embodiment of each of the above the composition is characterized as having a stacking fault energy (SFE) of between −0.4 and −2.1 mJ/m$^2$.

In an embodiment of each of the above the composition is characterized as having a difference in martensite start temperature (ΔMs) measuring less than 0, the difference being determined by subtracting α-martensite start temperature ($Ms^{\alpha}$) from ε-martensite start temperature ($Ms^{\varepsilon}$).

In an embodiment of each of the above the composition is characterized as having a difference in martensite start temperatures (ΔMs) measuring less than −92° C., the difference being determined by subtracting α-martensite start temperature ($Ms^{\alpha}$) from ε-martensite start temperature ($M^{\varepsilon}$).

In an embodiment of each of the above the composition is characterized as having an ε-martensite start temperature ($Ms^{\varepsilon}$) measuring between 90° C. and 111° C.

In an embodiment of each of the above the composition is characterized as having an α-martensite start temperature ($Ms^{\alpha}$) measuring between 190° C., ±100° C., and 225° C., ±100° C.

In an embodiment of each of the above the composition includes both α-martensite and ε-martensite.

In an embodiment of each of the above the composition includes γ-austenite and by % volume at least 20% of α-martensite and at least 20% ε-martensite after rolling the as cast strip.

In an embodiment of each of the above the composition includes by % volume at least 20% γ-austenite and at least 50% α-martensite and at least 20% ε-martensite after the thin metal strip is cold rolled 20 to 30% from the hot rolled and coiled thickness followed by annealing at 600 to 650° C. for 20 hours.

In an embodiment of each of the above the composition includes approximately equal amounts of γ-austenite and ε-martensite.

In an embodiment of each of the above the composition is characterized as having a yield strength of substantially 200 to 350 MPa, an ultimate tensile strength of 1340 to 1410 MPa, a % elongation of substantially 43%, a strength factor (K) of 4310±350 MPa, and a strain hardening exponent (n) of 0.69±0.04.

In an embodiment of each of the above the composition is characterized as having a yield strength of 650 to 710 MPa, an ultimate tensile strength of 1350 to 1410 MPa, a elongation of 25 to 35, a strength factor (K) of 3325 to 3650 MPa, and a strain hardening exponent (n) of 0.40 to 0.55.

In an embodiment of each of the above the thin metal strip as-cast thickness is less than 2 mm.

In an embodiment of each of the above, where after forming the thin metal strip, the thin metal strip extends through a hot rolling mill prior to coiling and cooling, where as a result of hot rolling, the sheet is reduced by 20% to 40% from an as-cast thickness.

In an embodiment of each of the above, where after forming the thin metal strip, the thin metal strip extends through a cold rolling mill, where as a result of cold rolling, the sheet is reduced by 20% to 30% from the hot rolled thickness.

In an embodiment of each of the above, where after forming the thin metal strip, the thin metal strip as-cast thickness undergoes hot reduction and then cold reduction.

In an embodiment of each of the above the composition comprises, by weight, greater than 12% and up to 17.5% manganese.

In one specific embodiment, A TRIP steel thin metal strip comprising:

an as-cast thickness of less than 3 mm;

the thin metal strip being formed of a steel alloy composition comprising:

by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting.

In an embodiment of each of the above the composition includes by weight up to 0.05% nitrogen.

In an embodiment of each of the above the composition includes by weight up to 0.1% niobium.

In an embodiment of each of the above the thin metal strip includes γ-austenite as a single phase microstructure.

In an embodiment of each of the above the thin metal strip includes γ-austenite as a tri-phase microstructure.

In an embodiment of each of the above the composition includes $M_{23}(CN)_6$ and/or NbC.

In an embodiment of each of the above the composition is characterized as having a stacking fault energy (SFE) of between −0.4 and −2.1 mJ/m$^2$.

In an embodiment of each of the above the composition is characterized as having a difference in martensite start temperature (ΔMs) measuring less than 0, the difference being determined by subtracting α-martensite start temperature ($Ms^{\alpha}$) from ε-martensite start temperature ($M^{\varepsilon}$).

In an embodiment of each of the above the composition is characterized as having a difference in martensite start temperatures (ΔMs) measuring less than −92° C., the difference being determined by subtracting α-martensite start temperature ($Ms^{\alpha}$) from ε-martensite start temperature ($M^{\varepsilon}$).

In an embodiment of each of the above the composition is characterized as having an ε-martensite start temperature ($Ms^{\varepsilon}$) measuring between 90° C. and 111° C.

In an embodiment of each of the above the composition is characterized as having an α-martensite start temperature ($Ms^{\alpha}$) measuring between 190° C., ±100° C., and 225° C., ±100° C.

In an embodiment of each of the above the composition is characterized as including both α-martensite and ε-martensite.

In an embodiment of each of the above the composition includes γ-austenite and by % volume at least 20% of α-martensite and at least 20% ε-martensite after rolling the as cast strip.

In an embodiment of each of the above the composition includes by % volume at least 20% γ-austenite and at least 50% α-martensite and at least 20% ε-martensite after the thin metal strip is cold rolled 20 to 30% from the hot rolled and coiled thickness followed by annealing at 600 to 650° C. for 20 hours.

In an embodiment of each of the above the composition includes approximately equal amounts of γ-austenite and ε-martensite.

In an embodiment of each of the above the composition is characterized as having a yield strength of substantially 200 to 350 MPa, an ultimate tensile strength of 1340 to 1410 MPa, a % elongation of substantially 43%, a strength factor (K) of 4310±350 MPa, and a strain hardening exponent (n) of 0.69±0.04.

In an embodiment of each of the above the composition is characterized as having a yield strength of 650 to 710 MPa, an ultimate tensile strength of 1350 to 1410 MPa, a elongation of 25 to 35, a strength factor (K) of 3325 to 3650 MPa, and a strain hardening exponent (n) of 0.40 to 0.55.

In an embodiment of each of the above the thin metal strip as-cast thickness is less than 2 mm.

In an embodiment of each of the above the composition comprises, by weight, greater than 12% and up to 17.5% manganese.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

What is claimed is:

1. A method of forming a TRIP steel thin metal strip comprising:

providing a pair of counter-rotatable casting rolls having casting surfaces laterally positioned to form a gap at a nip between the casting rolls through which a thin metal strip having an as-cast thickness of less than 3 mm can be cast;

providing a metal delivery system adapted to deliver molten metal above the nip to form a casting pool, the casting pool being supported on the casting surfaces of the pair of counter-rotatable casting rolls and confined at the ends of the casting rolls;

delivering a molten steel to the metal delivery system;

delivering the molten metal from metal delivery system above the nip to form the casting pool; and counter rotating the pair of counter-rotatable casting rolls to form metal shells on the casting surfaces of the casting rolls that are brought together at the nip to deliver the thin metal strip downwardly, the thin metal strip having an as-cast thickness less than 3 mm, the thin metal strip being formed of a steel alloy composition comprising:

by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting; and comprising by % volume at least 20% γ-austenite, at least 50% α-martensite, and at least 20% ε-martensite.

2. The method of claim 1, where the composition includes by weight up to 0.05% nitrogen.

3. The method of claim 1, where the composition includes by weight up to 0.1% niobium.

4. The method of claim 1, where the thin metal strip includes $M_{23}(C,N)_6$ and/or NbC.

5. The method of claim 1, where the composition is characterized as having a stacking fault energy (SFE) of between −0.4 and −2.1 mJ/m$^2$.

6. The method of claim 1, where the composition is characterized as having a difference in martensite start temperature (ΔMs) measuring less than 0, the difference being determined by subtracting α-martensite start temperature ($Ms^{\alpha}$) from ε-martensite start temperature ($Ms^{\varepsilon}$).

7. The method of claim 1, where the composition is characterized as having a difference in martensite start temperatures (ΔMs) measuring less than −92° C., the difference being determined by subtracting α-martensite start temperature ($Ms^{\alpha}$) from ε-martensite start temperature ($Ms^{\varepsilon}$).

8. The method of claim 1, where the composition is characterized as having an ε-martensite start temperature ($Ms^{\varepsilon}$) measuring between 90° C. and 111° C.

9. The method of claim 1, where the composition is characterized as having an α-martensite start temperature ($Ms^{\alpha}$) measuring between 190° C., ±100° C., and 225° C., ±100° C.

10. The method of claim 1, where the thin metal strip is cold rolled 20 to 30% from the hot rolled and coiled thickness followed by annealing at 600 to 650° C. for 20 hours.

11. The method of claim 1, where the thin metal strip includes approximately equal amounts of γ-austenite and ε-martensite.

12. The method of claim 1, where the composition is characterized as having a yield strength of substantially 200 to 350 MPa, an ultimate tensile strength of 1340 to 1410 MPa, a % elongation of substantially 43%, a strength factor (K) of 4310±350 MPa, and a strain hardening exponent (n) of 0.69±0.04.

13. The method of claim 1, where the composition is characterized as having a yield strength of 650 to 710 MPa, an ultimate tensile strength of 1350 to 1410 MPa, a % elongation of 25 to 35, a strength factor (K) of 3325 to 3650 MPa, and a strain hardening exponent (n) of 0.40 to 0.55.

14. The method of claim 1, where the thin metal strip as-cast thickness is less than 2 mm.

15. The method of claim 1, where after forming the thin metal strip, the thin metal strip extends through a hot rolling mill prior to coiling and cooling, where as a result of hot rolling, the sheet is reduced by 20% to 40% from the as-cast thickness.

16. The method of claim 1, where after forming the thin metal strip, the thin metal strip extends through a cold rolling mill, where as a result of cold rolling, the sheet is reduced by 20% to 30% from the hot rolled thickness.

17. The method of claim 1, where after forming the thin metal strip, the thin metal strip as-cast thickness undergoes hot reduction and then cold reduction.

18. The method of claim 1, where the composition comprises, by weight, greater than 12% and up to 17.5% manganese.

19. A TRIP steel thin metal strip comprising:

an as-cast thickness of less than 3 mm;

the thin metal strip being formed of a steel alloy composition comprising:

by weight, up to substantially 0.23% carbon, substantially between 1.0% and 6% chromium, substantially between 10% and 17.5% manganese, substantially between 0.5% and 1.75% silicon, and iron, with a residual aluminum content of less than 0.01% aluminum and other impurities resulting from melting; and by % volume at least 20% γ-austenite, at least 50% α-martensite, and at least 20% ε-martensite.

20. The thin metal strip of claim 19, where the composition includes by weight up to 0.05% nitrogen.

21. The thin metal strip of claim 19, where the composition includes by weight up to 0.1% niobium.

22. The thin metal strip of claim 19, where the thin metal strip includes $M_{23}(C,N)_6$ and/or NbC.

23. The thin metal strip of claim 19, where the composition is characterized as having a stacking fault energy (SFE) of between −0.4 and −2.1 $mJ/m^2$.

24. The thin metal strip of claim 19, where the composition is characterized as having a difference in martensite start temperature (ΔMs) measuring less than 0, the difference being determined by subtracting α-martensite start temperature ($Ms^{\alpha}$) from ε-martensite start temperature ($Ms^{\varepsilon}$).

25. The thin metal strip of claim 19, where the composition is characterized as having a difference in martensite start temperatures (ΔMs) measuring less than −92° C., the difference being determined by subtracting α-martensite start temperature ($Ms^{\alpha}$) from ε-martensite start temperature ($Ms^{\varepsilon}$).

26. The thin metal strip of claim 19, where the composition is characterized as having an ε-martensite start temperature ($Ms^{\varepsilon}$) measuring between 90° C. and 111° C.

27. The thin metal strip of claim 19, where the composition is characterized as having an α-martensite start temperature ($Ms^{\alpha}$) measuring between 190° C., ±100° C., and 225° C., ±100° C.

28. The thin metal strip of claim 19, where the thin metal strip is cold rolled 20 to 30% from the hot rolled and coiled thickness followed by annealing at 600 to 650° C. for 20 hours.

29. The thin metal strip of claim 19, where the thin metal strip includes approximately equal amounts of γ-austenite and ε-martensite.

30. The thin metal strip of claim 19, where the composition is characterized as having a yield strength of substantially 200 to 350 MPa, an ultimate tensile strength of 1340 to 1410 MPa, a % elongation of substantially 43%, a strength factor (K) of 4310±350 MPa, and a strain hardening exponent (n) of 0.69±0.04.

31. The thin metal strip of claim 19, where the composition is characterized as having a yield strength of 650 to 710 MPa, an ultimate tensile strength of 1350 to 1410 MPa, a % elongation of 25 to 35, a strength factor (K) of 3325 to 3650 MPa, and a strain hardening exponent (n) of 0.40 to 0.55.

32. The thin metal strip of claim 19, where the thin metal strip as-cast thickness is less than 2 mm.

33. The thin metal strip of claim 19, where the thin metal strip is being formed of the composition comprising, by weight, greater than 12% and up to 17.5% manganese.

* * * * *